US009402426B2

(12) United States Patent
Koga et al.

(10) Patent No.: US 9,402,426 B2
(45) Date of Patent: Aug. 2, 2016

(54) UPPER GARMENT

(75) Inventors: Yutaka Koga, Kobe (JP); Yoshikuni Takamoto, Kobe (JP); Mamoru Omuro, Kobe (JP); Makoto Katsu, Kobe (JP)

(73) Assignee: ASICS CORPORATION, Kobe-Shi (JP)

( * ) Notice: Subject to any disclaimer, the term of this patent is extended or adjusted under 35 U.S.C. 154(b) by 939 days.

(21) Appl. No.: 12/937,079

(22) PCT Filed: Apr. 10, 2008

(86) PCT No.: PCT/JP2008/057108
§ 371 (c)(1),
(2), (4) Date: Oct. 8, 2010

(87) PCT Pub. No.: WO2009/125487
PCT Pub. Date: Oct. 15, 2009

(65) Prior Publication Data

US 2011/0035859 A1 Feb. 17, 2011

(51) Int. Cl.

| | |
|---|---|
| ***A41B 1/08*** | (2006.01) |
| ***A41D 13/00*** | (2006.01) |
| ***A41D 27/10*** | (2006.01) |
| *A41B 1/00* | (2006.01) |

(52) U.S. Cl.
CPC ..... *A41D 13/0015* (2013.01); *A41D 27/10* (2013.01); *A41B 1/00* (2013.01); *A41B 1/08* (2013.01); *Y10S 2/04* (2013.01)

(58) Field of Classification Search
CPC ... A41D 27/10; A41D 27/00; A41D 2400/38; Y10S 2/04
USPC ..... 33/11, 12, 17, 17 R, 17 A; 2/125, 93, 2/113, 106, 115, 114, 81, 77, 85, 105, 2/108, 109, 133
See application file for complete search history.

(56) References Cited

U.S. PATENT DOCUMENTS

| | | | | |
|---|---|---|---|---|
| 1,965,995 | A * | 7/1934 | Tripp | 2/93 |
| 2,021,586 | A * | 11/1935 | Adler | 2/74 |
| 2,291,025 | A * | 7/1942 | Casella | 2/93 |

(Continued)

FOREIGN PATENT DOCUMENTS

| | | |
|---|---|---|
| JP | 58-087309 | 5/1983 |
| JP | 60-52918 | 4/1985 |

(Continued)

*Primary Examiner* — Andrew W Collins
*Assistant Examiner* — Brieanna Szafran
(74) *Attorney, Agent, or Firm* — Mintz Levin Cohn Ferris Glovsky and Popeo, P.C.

(57) ABSTRACT

Patterns for bodies and sleeves are devised to reduce the pull of the bodies from the sleeves when an arm is moved up, down, forward and backward. In an upper garment 1, portions 67 and 87 to be sewn to a first sewing reference position 6 on a front body 2 in a front portion to be sewn 54 in a front sleeve portion 51 project toward the front body 2 relative to a shoulder point SP, and project toward the front body 2 relative to a boundary point 65 between the front portion to be sewn 54 and the first end portion to be sewn 6, and portions 72 and 89 to be sewn to a second sewing reference position 12 on a back body 3 in a back portion to be sewn 55 in a back sleeve portion 52 project toward the back body 3 relative to the shoulder point SP, and project toward the back body 3 relative to a boundary point 70 between the back portion to be sewn 55 and the second end portion to be sewn 12.

4 Claims, 21 Drawing Sheets

(56) References Cited

U.S. PATENT DOCUMENTS

| | | | | |
|---|---|---|---|---|
| 2,379,511 | A * | 7/1945 | Federman | 2/93 |
| 3,013,275 | A * | 12/1961 | Heilbronner | 2/113 |
| 3,369,300 | A * | 2/1968 | Green | 33/17 R |
| 3,614,789 | A * | 10/1971 | Menut | 2/93 |
| 3,660,851 | A * | 5/1972 | Marroni, Jr. | 2/2.11 |
| 3,719,956 | A * | 3/1973 | Glassberg | 2/125 |
| 4,208,742 | A * | 6/1980 | Maos | 2/93 |
| 4,510,626 | A * | 4/1985 | Bowditch | 2/115 |
| 5,165,110 | A * | 11/1992 | Grilliot et al. | 2/93 |
| D504,202 | S | 4/2005 | Coutant | |
| 7,913,323 | B2 | 3/2011 | Takamoto et al. | |
| 8,381,314 | B2 | 2/2013 | Takamoto et al. | |
| 8,893,312 | B2 | 11/2014 | Takamoto et al. | |
| 2011/0035859 | A1 | 2/2011 | Koga et al. | |
| 2012/0011635 | A1 | 1/2012 | Tsuji et al. | |

FOREIGN PATENT DOCUMENTS

| | | |
|---|---|---|
| JP | 61-11725 | 1/1986 |
| JP | 62-36812 | 9/1987 |
| JP | 63-734 | 1/1988 |
| JP | 9-310213 | 2/1997 |
| JP | 9-95809 | 8/1997 |
| JP | 2872125 | 3/1999 |
| JP | 11-36118 | 9/1999 |
| JP | 2005-299023 | 10/2005 |
| JP | 2006-283214 | 10/2006 |
| JP | 2007-247083 | 9/2007 |
| WO | WO-2009/125487 A1 | 10/2009 |

* cited by examiner

UPPER GARMENT

RELATED APPLICATIONS

This application is a U.S. National Phase Application under 35 U.S.C. 371 of International Application No. PCT/JP2008/057108 filed Apr. 10, 2008, which was published on Oct. 15, 2009 under International Publication Number WO 2009/125487 A1. The foregoing application is incorporated herein by reference in its entirety.

FIELD OF THE INVENTION

The present invention relates to an upper garment worn on the upper half of the body of a wearer.

RELATED ART

Conventionally, for example, as shown in FIG. 17, a set-in-type upper garment 101 is manufactured by sewing sleeves 104 at predetermined positions on bodies 102 and 103. FIG. 18 is a developed view of a pattern for making this upper garment 101. As shown in FIG. 18, the upper garment 101 is manufactured by sewing each sleeve 104 to the front and back bodies 102 and 103. A portion 105 of the sleeve 104 of the upper garment 101 to be sewn to the bodies 102 and 103 is formed into a circular-arc shape. The sleeve 104 is sewn to the bodies 102 and 103, with a point SP at the apex of the portion 105 (hereinafter referred to as a "shoulder point") just placed on a shoulder line 106 of the bodies 102 and 103. The shoulder point SP is set so as to be positioned on a sleeve head seam line 107 passing through the sleeve 104 generally at a center of the sleeve 104 in the widthwise direction of the sleeve 104 in the unfolded state (see, for example, Patent Documents 1 to 3).

In the upper garment 101 made in this way, the sleeves 104 are formed so as to be slant downward relative to the slanting directions of the shoulder lines 106 of the bodies 102 and 103, as shown in FIG. 17.

A set-in-type upper garment exists in which a portion of each of sleeves to be sewn to bodies is concaved most largely at the position (shoulder point) corresponding to the sleeve head seam line (see, for example, Patent Document 4). When a sleeve having such a shape is sewn to bodies, the sleeve is formed so as to be slant upward relative to the slanting direction of the shoulder line 106 of the bodies 102 and 103, as shown in FIG. 1 of Patent Document 4.

In another example of conventional set-in-type upper garments, an underarm gusset in lunette form is attached in the armhole formed between connecting portions of front and back bodies and a sleeve so as to extend between front and rear positions on the front and back sides of a lower portion of a sleeve (see, for example, Patent Document 5).

In still another example of conventional set-in-type upper garments, a dart is provided in a sleeve portion at the sleeve head to facilitate fitting to the body and improve the appearance. (see, Patent Document 6).

In a further example of conventional set-in-type upper garments, an arced convex edge (10*a*) and angular convex edges (10*d*, 10*e*) connecting to the arced convex edge on opposite sides of the arced convex edge through valley edges (10*b*, 10*c*) formed therebetween are formed in a portion of a sleeve to be sewn to front and back bodies (sleeve attachment line) (see, for example, Patent Document 7). With this arrangement, the conventional upper garment is made free from an underarm stretch phenomenon at the time of raising the arm high and the occurrences of bags and wrinkles under the armpit and along the chest breadth accompanied with an action of moving down the arm.

Also, a raglan-type upper garment 101, such as the one shown in FIGS. 19 and 20, exists in which part of a sleeve 104 is formed so as to reach a neckline 108 of bodies 102 and 103. That is, the sleeve 104 has a projecting portion 109 projecting toward the neckline 108 of the bodies 102 and 103 (see, for example, Patent Document 8). A portion 110 in the projecting portion 109 is sewn to the front body 102, while the other portion 111 is sewn to the back body 103.

In this projecting portion 109, the edge of the portion 110 sewn to the front body 102 is represented by a curve concaved toward the sleeve head seam line 107 passing through the sleeve 104 generally at a center of the sleeve 104 in the widthwise direction of the sleeve 104. Similarly, in the projecting portion 109, the edge (sleeve attachment line) of the portion 111 sewn to the back body 103 is represented by a curve concaved toward the sleeve head seam line 107.

In a case where the portion 110 sewn to the front body 102 and the portion 111 sewn to the back body 103 are formed into curves concaved toward the sleeve head seam line 107 in this way in the projecting portion 109, the sleeve 104 is formed so as to be slant downward relative to the slanting direction of the shoulder line 106 of the bodies 102 and 103 when the sleeve 104 is sewn to the bodies 102 and 103 (see FIG. 19).

In another example of conventional raglan-type upper garments, the edge (sleeve attachment line) of a sleeve (sleeve body 1) to be sewn to a front or back body 2 is a generally S-shaped three-order curve having an inflection point (9, 10) on the underarm side relative to a seam center position (see, for example, Patent Document 9).

The related art has provided only few upper garments by considering all up/down and frontward/backward movements of the arm. Upper garments designed by considering such movements include one using a gusset (Patent Document 5) and one having the armhole made markedly large. The one having the armhole made markedly large does not follow such movements. It is difficult to enable following all up/down and frontward/backward movements of the arm by only devising essentially the pattern of bodies and sleeves without using a part such as a gusset and without making the armhole markedly large.

Patent Document 1: Japanese Patent Laid-Open No. 2007-247083

Patent Document 2: Japanese Patent Laid-Open No. 2006-283214

Patent Document 3: Japanese Utility Model Laid-Open No. 61-11725

Patent Document 4: Japanese Patent Laid-Open No. 11-36118

Patent Document 5: Japanese Patent Laid-Open No. 9-310213

Patent Document 6: Japanese Patent Publication No. 2872125

Patent Document 7: Japanese Utility Model Publication No. 63-734

Patent Document 8: Japanese Patent Laid-Open No. 58-087309

Patent Document 9: Japanese Utility Model Publication No. 62-36812

DISCLOSURE OF THE INVENTION

Problems to be Solved by the Invention

For example, a wearer may largely swing his/her arms up and down when he or she does a physical exercise while wearing a set-in-type or raglan-type upper garment. In such a case, the bodies of the conventional upper garment are pulled by the sleeves when the arms are swung up and down, because the sleeves are slant downward relative to the slope of the shoulder line of the bodies. This causes a resistance to the movement of the arms and, in some case, makes it difficult to perform the desired movements of the arms. The conventional upper garments include those having the sleeves formed so as to be slant upward relative to the slope of the shoulder line of the bodies. Also when a wearer who wears such a garment swings his/her arms forward and backward, the bodies are pulled by the sleeves to cause a resistance to the movements of the arms.

It is, therefore, an object of the present invention to provide, by devising a pattern for bodies and sleeves, an upper garment capable of largely reducing the pull of the bodies from the sleeves (that is, capable of following the movements of the arms) when the arms are moved up, down, forward and backward.

Means for Solving Problems

Technical means described below are devised to solve the above-described problems.

According to the present invention, there is provided an upper garment having a front body, a back body, sleeves sewn to the bodies and worn on the upper half of the body of a wearer, the upper garment being characterized in that each sleeve has a front sleeve portion and a back sleeve portion and is formed into a tubular shape by sewing the front sleeve portion and the back sleeve portion to each other; the front sleeve portion has a front portion to be sewn, which is sewn to the front body, and a first end portion to be sewn, which is sewn to the back sleeve portion to form the sleeve portions into the tubular shape; the back sleeve portion has a back portion to be sewn, which is sewn to the back body, and a second end portion to be sewn, which is sewn to the front sleeve portion to form the sleeve portions into the tubular shape; a boundary portion between the front portion to be sewn and the back portion to be sewn forms a shoulder point corresponding to the outer end of the shoulder of the wearer when the front portion to be sewn is sewn to the front body, and when the back portion to be sewn is sewn to the back body; the front body has a first portion to be sewn, to which the front portion to be sewn of the sleeve is sewn, and on which a first sewing reference position serving as a reference when the front portion to be sewn of the sleeve is sewn is set, the first sewing reference position being positioned nearest to a center of the front body in a widthwise direction in the first portion to be sewn; the back body has a second portion to be sewn, to which the back portion to be sewn of the sleeve is sewn, and on which a second sewing reference position serving as a reference when the back portion to be sewn of the sleeve is sewn is set, the second sewing reference position being positioned nearest to a center of the back body in a widthwise direction in the second portion to be sewn; a portion to be sewn to the first sewing reference position on the front body in the front portion to be sewn in the front sleeve portion projects toward the front body relative to the shoulder point, and projects toward the front body relative to a boundary point between the front portion to be sewn and the first end portion to be sewn; and a portion to be sewn to the second sewing reference position on the back body in the back portion to be sewn in the back sleeve portion projects toward the back body relative to the shoulder point, and projects toward the back body relative to a boundary point between the back portion to be sewn and the second end portion to be sewn, so that the shoulder point on the sleeve is positioned between the portion in the front portion to be sewn in the front sleeve portion, which portion is sewn to the first sewing reference position on the front body, and the portion in the back portion to be sewn in the back sleeve portion, which portion is sewn to the second sewing reference position on the back body, and at a bottom most portion in a concave portion formed by a front sleeve attachment line representing an edge of the front portion to be sewn and a back sleeve attachment line representing an edge of the back portion to be sewn, while part of the sleeve is positioned above a line extended from a shoulder line on the front body when the sleeve is sewn to the front body and to the back body.

In this arrangement, the first sewing reference position on the front body is set at a position nearest to the center of the front body in the widthwise direction in the first portion to be sewn, and the portion to be sewn to the first sewing reference position on the front body in the front portion to be sewn in the front sleeve portion is formed so as to project toward the front body relative to the shoulder point, and project toward the front body relative to the boundary point between the front portion to be sewn and the first end portion to be sewn, thereby producing in an area in the vicinity of the front portion to be sewn of the sleeve "ease" for following the movement of the arm. Because this ease is produced, the pull of the body from the sleeve can be reduced even when the wearer moves the sleeve up, down, forward and backward.

Moreover, the second sewing reference position on the back body is set at a position nearest to the center of the back body in the widthwise direction in the second portion to be sewn, and the portion to be sewn to the second sewing reference position on the back body in the back portion to be sewn in the back sleeve portion projects toward the back body relative to the shoulder point, and projects toward the back body relative to a boundary point between the back portion to be sewn and the second end portion to be sewn, thereby producing ease in an area in the vicinity of the back portion to be sewn of the sleeve. Because the ease is produced in the sleeve, the pull of the body from the sleeve can be reduced even when the wearer moves the sleeve up, down, forward and backward.

According to the present invention, there is also provided an upper garment having a front body, a back body, sleeves sewn to the bodies and worn on the upper half of the body of a wearer, the upper garment being characterized in that each sleeve has a front sleeve portion and a back sleeve portion and is formed into a tubular shape by sewing the front sleeve portion and the back sleeve portion to each other; the front sleeve portion has a front portion to be sewn, which is sewn to the front body, and a first end portion to be sewn, which is sewn to the back sleeve portion to form the sleeve portions into the tubular shape; the back sleeve portion has a back portion to be sewn, which is sewn to the back body, and a second end portion to be sewn, which is sewn to the front sleeve portion to form the sleeve portions into the tubular shape; a boundary portion between the front portion to be sewn and the back portion to be sewn forms a shoulder point corresponding to the outer end of the shoulder of the wearer when the front portion to be sewn is sewn to the front body, and when the back portion to be sewn is sewn to the back body; the front body has a first portion to be sewn, to which the front portion to be sewn of the sleeve is sewn, and on which a first sewing reference position serving as a reference when the front portion to be sewn of the sleeve is sewn is set, the first sewing reference position being positioned nearest to a center of the front body in a widthwise direction in the first portion to be sewn; the back body has a second portion to be sewn, to which the back portion to be sewn of the sleeve is sewn, and on which a second sewing reference position serving as a reference when the back portion to be sewn of the sleeve is sewn is set, the second sewing reference position being positioned nearest to a center of the back body in a widthwise direction in the second portion to be sewn; a portion to be sewn to the first sewing reference position on the front body in the front portion to be sewn in the front sleeve portion projects toward the front body relative to the shoulder point, and projects toward the front body relative to a boundary point between the front portion to be sewn and the first end portion to be sewn; and a portion to be sewn to the second sewing reference position on the back body in the back portion to be sewn in the back sleeve portion projects toward the back body relative to the shoulder point, and projects toward the back body relative to a boundary point between the back portion to be sewn and the second end portion to be sewn, so that the shoulder point on the sleeve is positioned at a center of the sleeve in the widthwise direction and at a bottom most portion in a concave formed by a front sleeve attachment line representing an edge of the front portion to be sewn and a back sleeve attachment line representing an edge of the back portion to be sewn, while part of the sleeve is positioned above a line extended from a shoulder line on the front body when the sleeve is sewn to the front body and to the back body.

In this arrangement, the first sewing reference position on the front body is set at a position nearest to the center of the front body in the widthwise direction in the first portion to be sewn, and the portion to be sewn to the first sewing reference position on the front body in the front portion to be sewn in the front sleeve portion projects toward the front body relative to the shoulder point, projects toward the front body relative to a base portion in the projecting portion, and projects toward the front body relative to the boundary point between the front portion to be sewn and the first end portion to be sewn, thereby producing ease in an area in the vicinity of the front portion to be sewn of the sleeve. Because this ease is produced, the pull of the body from the sleeve can be reduced even when the wearer moves the sleeve up, down, forward and backward.

Also, the second sewing reference position on the back body is set at a position nearest to the center of the back body in the widthwise direction in the second portion to be sewn, and the portion to be sewn to the second sewing reference position on the back body in the back portion to be sewn in the back sleeve portion projects toward the back body relative to the shoulder point, projects toward the back body relative to a base portion in the projecting portion, and projects toward the back body relative to a boundary point between the back portion to be sewn and the second end portion to be sewn, thereby producing ease in an area in the vicinity of the front portion to be sewn of the sleeve. Because the ease is produced in the sleeve, the pull of the body from the sleeve can be reduced even when the wearer moves the sleeve up, down, forward and backward.

According to the present invention, an arrangement can be adopted in which the first sewing reference position is set in correspondence with the crest of greater tubercle of the wearer.

In this arrangement, the first sewing reference position on the front body is set in correspondence with the crest of greater tubercle of the wearer to which the greater pectoral muscle inserts, so that the pull of the front body from the sleeve can be reduced more effectively. That is, the muscles move largely and strongly in a place in the vicinity of the crest of greater tubercle. Part of the sleeve is disposed at this position to enable the sleeve to follow the movement, so that the pull of the front body from the sleeve can be reduced.

According to the present invention, an arrangement can be adopted in which the second sewing reference position is set in correspondence with the infraglenoid tubercle of the wearer.

In this arrangement, because of the provision on the infraglenoid tubercle of the blade bone of the wearer in which the long head of the triceps brachii muscle originates, the pull of the back body from the sleeve can be reduced more effectively. That is, the muscles move largely and strongly in a place in the vicinity of the infraglenoid tubercle. Part of the sleeve is disposed at this position to enable the sleeve to follow the movement, so that the pull of the back body from the sleeve can be reduced.

According to the present invention, an arrangement can be adopted in which a sleeve width line connecting the boundary point between the front portion to be sewn and the first end portion to be sewn and the boundary point between the back portion to be sewn and the second end portion to be sewn and extending along the widthwise direction is drawn, and in which if the length of a line drawn from the shoulder point so as to be orthogonal to the sleeve width line is A; the length of a line drawn from the portion sewn to the first sewing reference position on the front body in the front portion to be sewn in the front sleeve portion so as to be orthogonal to the sleeve width line is B; and the length of a line drawn from the portion sewn to the second sewing reference position on the back body in the back portion to be sewn in the back sleeve portion so as to be orthogonal to the sleeve width line is C, relationship of $A<B$ and a relationship of $A<C$ are established.

In this arrangement, A, B, and C are set in the above-described relationships to form the sleeve of the upper garment so that the sleeve of the upper garment is formed so as to be slant upward relative to the slope of the shoulder line of the body, thereby avoiding the pull of the body from the sleeve more effectively when the wearer moves the arm up and down.

Advantages of the Invention

According to the present invention, it is possible to reduce the pull of the bodies from the sleeves when a person wearing the upper garment moves the arms up, down, forward and backward (that is, following the movements of the arms is enabled).

BRIEF DESCRIPTION OF THE DRAWINGS

FIG. 10(*a*) is a front view when a conventional upper garment is worn; and FIG. 10(*b*) is a front view when the upper garment of the present invention is worn.

FIG. 11(*a*) is a plan view when the conventional upper garment is worn; and FIG. 11(*b*) is a plan view when the upper garment of the present invention is worn.

DESCRIPTION OF SYMBOLS

Figure 1:
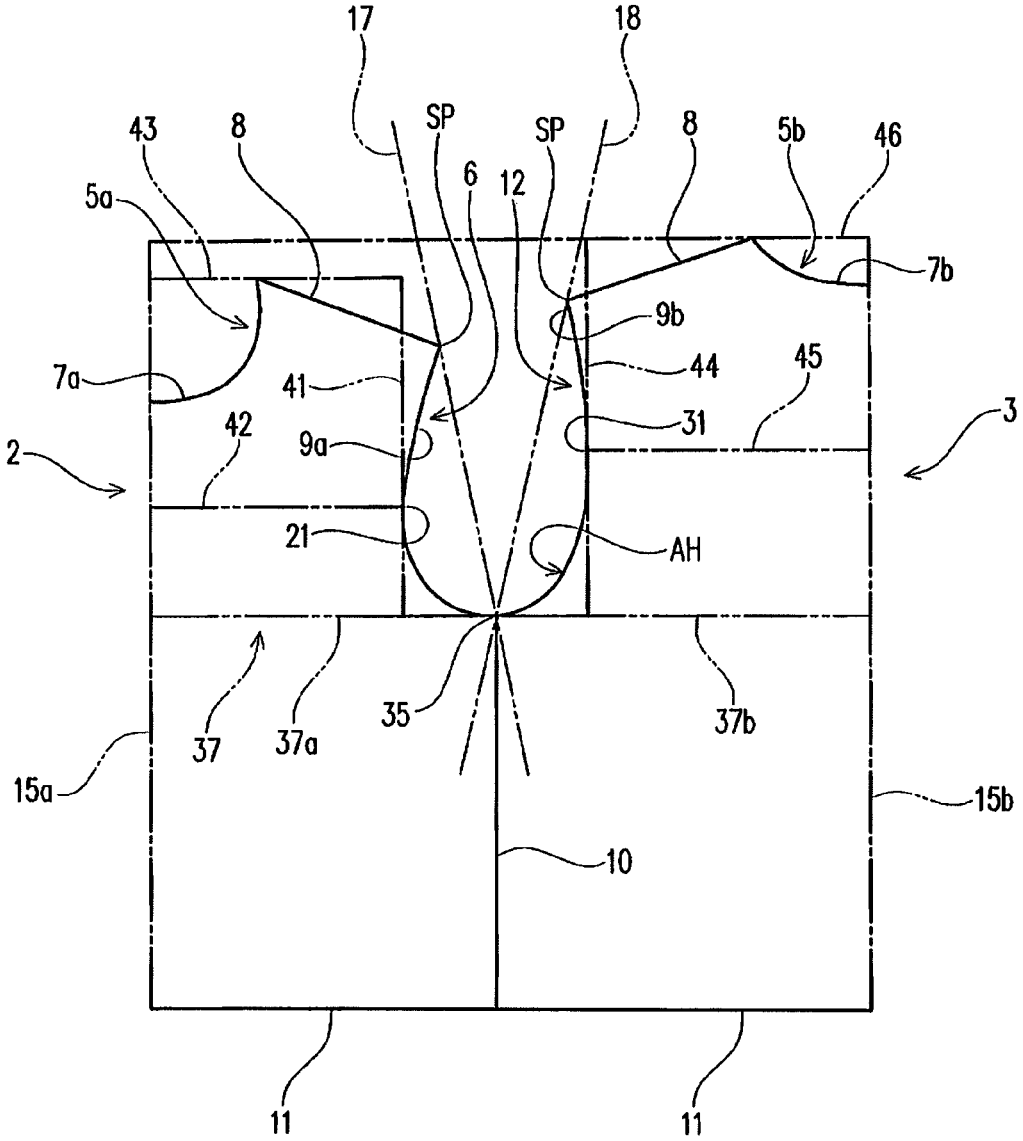
FIG. 1 is a developed view of a combination of a half of a front body and a half of a back body, showing a first embodiment.

1 Upper garment
2 Front body
3 Back body
4 Sleeve
6 First portion to be sewn
12 Second portion to be sewn
21 First sewing reference position
25 Greater pectoral muscle
26 Crest of greater tubercle
51 Front sleeve portion
52 Back sleeve portion
54 Front portion to be sewn
55 Back portion to be sewn
81 Projecting portion
SP Shoulder point

DETAILED DESCRIPTION OF THE PREFERRED EMBODIMENT

The best mode for carrying out the present invention will be described with reference to the drawings.

FIGS. 1 to 11 show a first embodiment of an upper garment. A so-called set-in-type upper garment 1 with half-length sleeves will be described as the first embodiment by way of example.

FIGS. 1 to 4 show a pattern made in advance for manufacture of the upper garment 1. The upper garment 1 is formed into the desired shape by cutting a sheet of cloth into pieces on the basis of the pattern and by sewing the pieces of cloth one to another. The upper garment 1 will be described on the basis of the pattern.

The upper garment 1 has a front body 2, a back body 3 and sleeves 4. The front body 2 has a front neck 5*a* forming a neckline of the upper garment 1 and an armhole (hereinafter referred to as a "first portion to be sewn") 6 to which the sleeve 4 is sewn. The front body 2 is defined with a shoulder line 8 slanting at a predetermined angle from the upper end of a front neckline 7*a* representing the edge of the front neck 5*a* to the upper end of the first portion to be sewn 6, a line (hereinafter referred to as a "front armhole line") 9*a* representing the edge of the first portion to be sewn 6, a side line 10 drawn vertically from the lower end of the front armhole line 9*a*, and a bottom line 11 drawn substantially horizontally from the lower end of the side line 10.

The upper end of the first portion to be sewn 6 is generally called a shoulder point SP. The shoulder point SP is a position (point) corresponding to the outer end of the shoulder of a wearer when the wearer wears the upper garment 1.

The back body 3 has a back neck 5*b* forming the neckline of the upper garment 1 and an armhole (hereinafter referred to as a "second portion to be sewn") 12 to which the sleeve 4 is sewn. The back body 3 is defined with a shoulder line 8 slanting at a predetermined angle from the upper end of a back neckline 7*b* representing the edge of the back neck 5*b* to the upper end of the second portion to be sewn 12, a line (hereinafter referred to as a "back armhole line") 9*b* representing the edge of the second portion to be sewn 12, a side line 10 drawn vertically from the lower end of the back armhole line 9*b*, a bottom line 11 drawn substantially horizontally from the lower end of the side line 10, and the like.

The upper end of the second portion to be sewn 12 is a shoulder point SP, as is the upper end of the first portion to be sewn 6. The front body 2 and the back body 3 are sewn to each other so that the shoulder point SP on the first portion to be sewn 6 and the shoulder point SP on the second portion to be sewn 12 coincide with each other.

Figure 3:
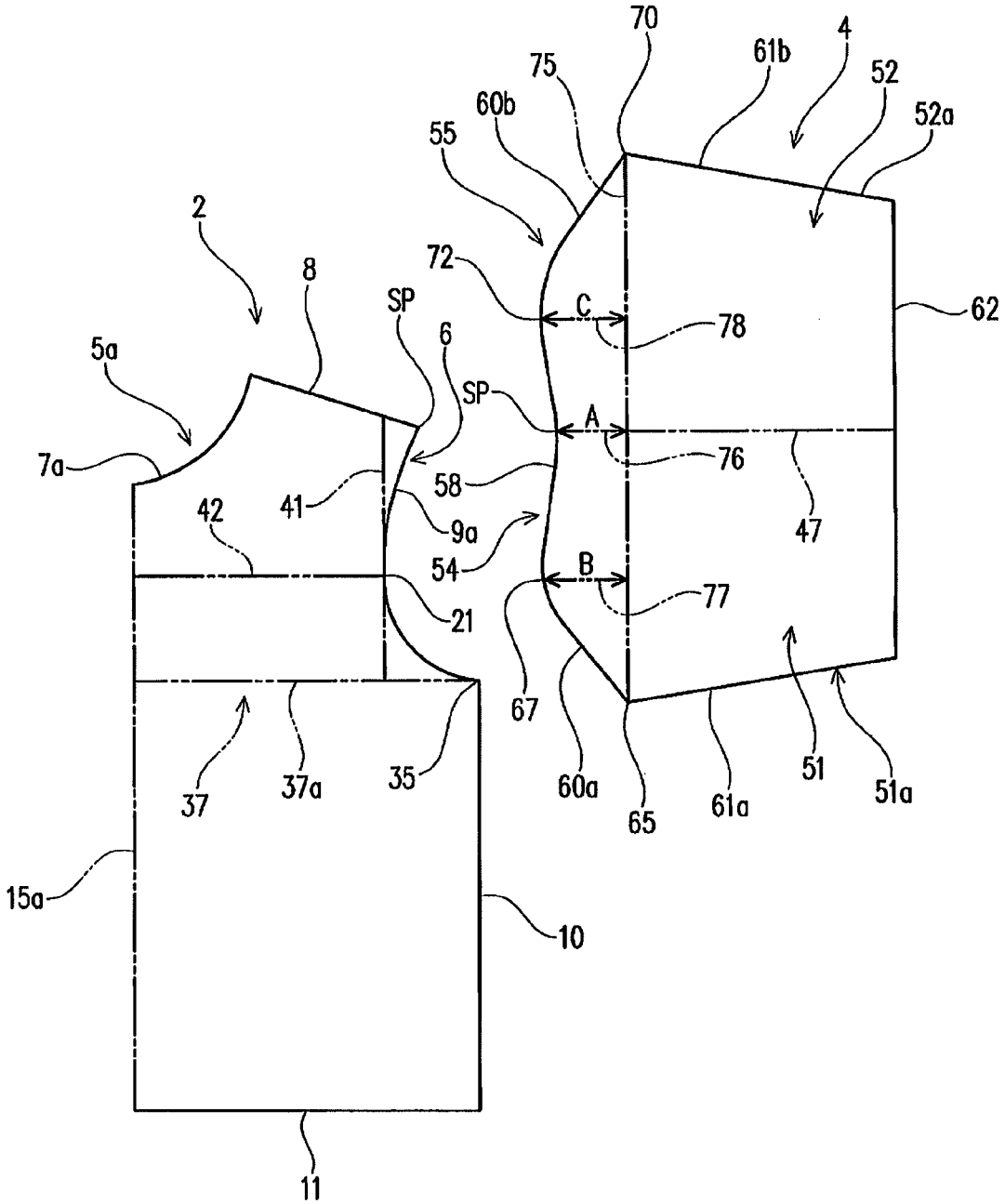
FIG. 3 is a developed view showing the front body and the sleeve.
Figure 4:
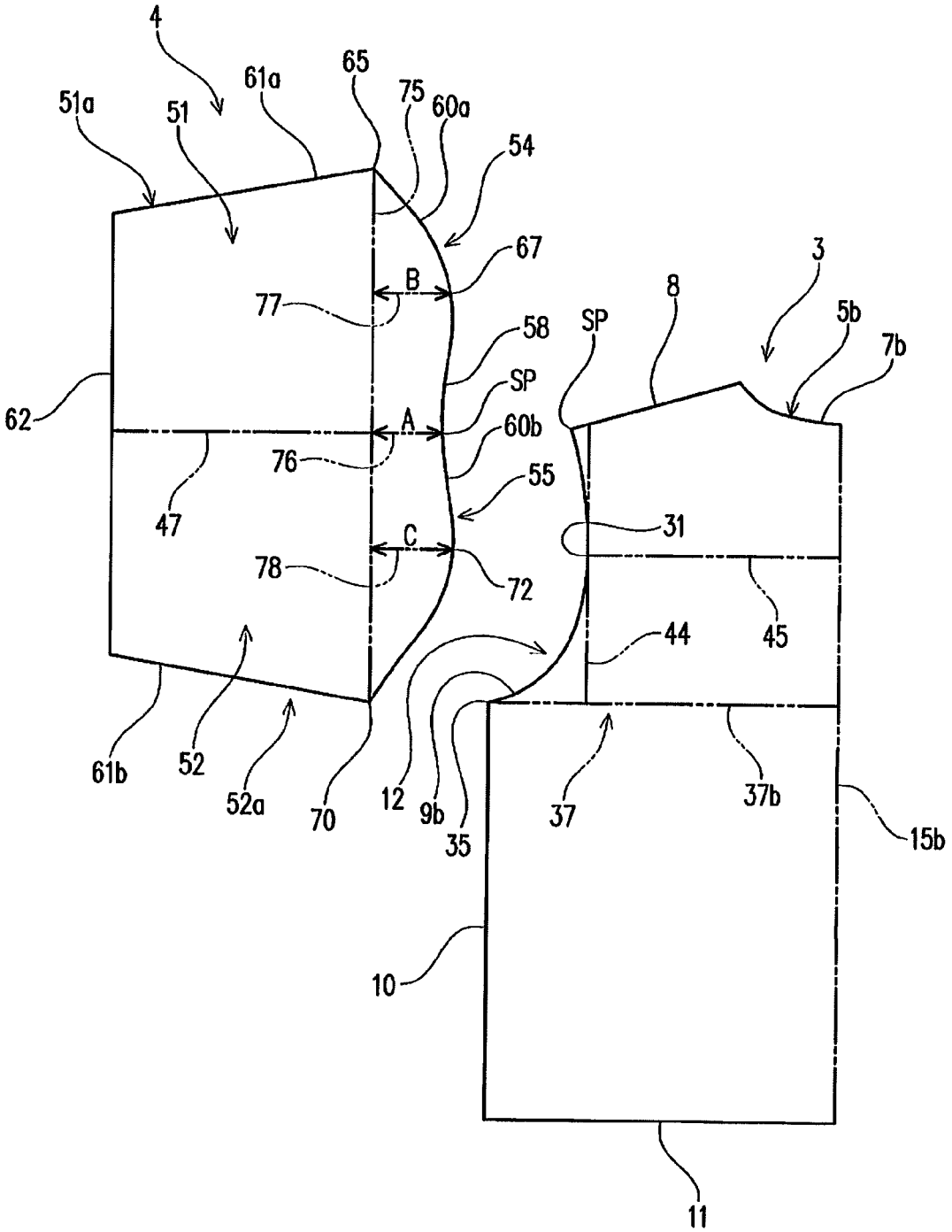
FIG. 4 is a developed view showing the back body and the sleeve.
Figure 5:
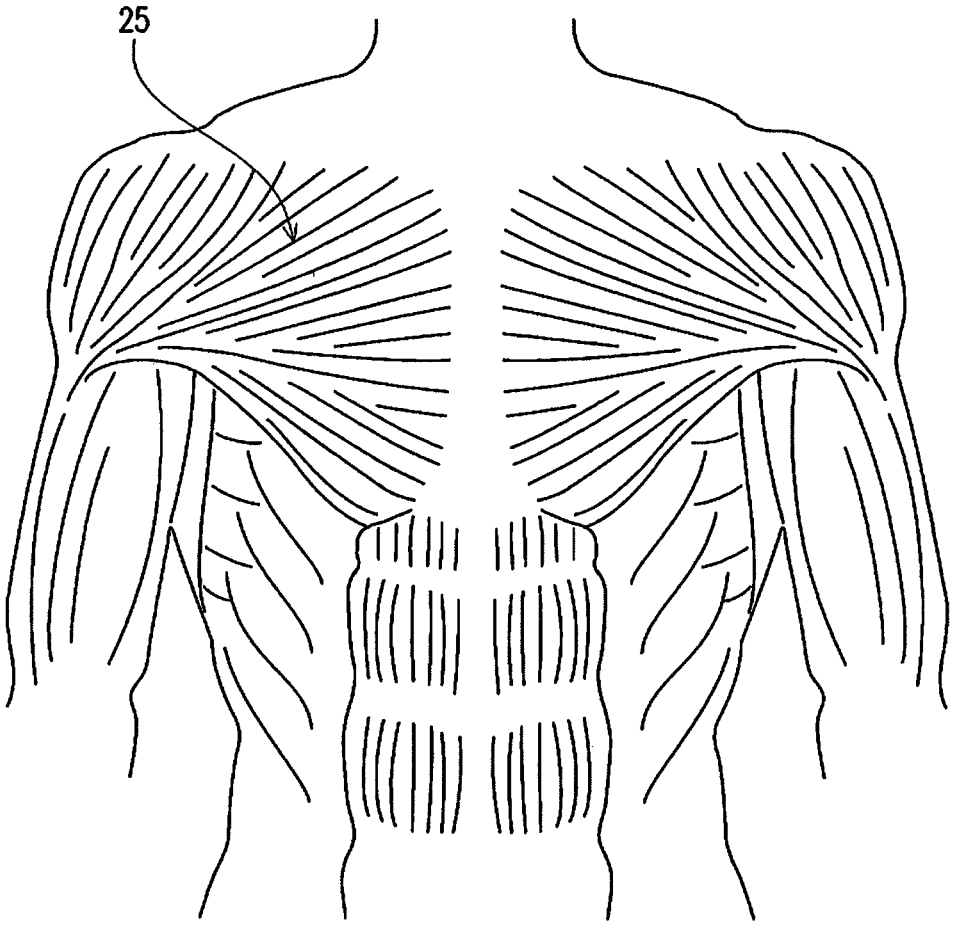
FIG. 5 is a front view showing the upper half of a human body.
Figure 6:
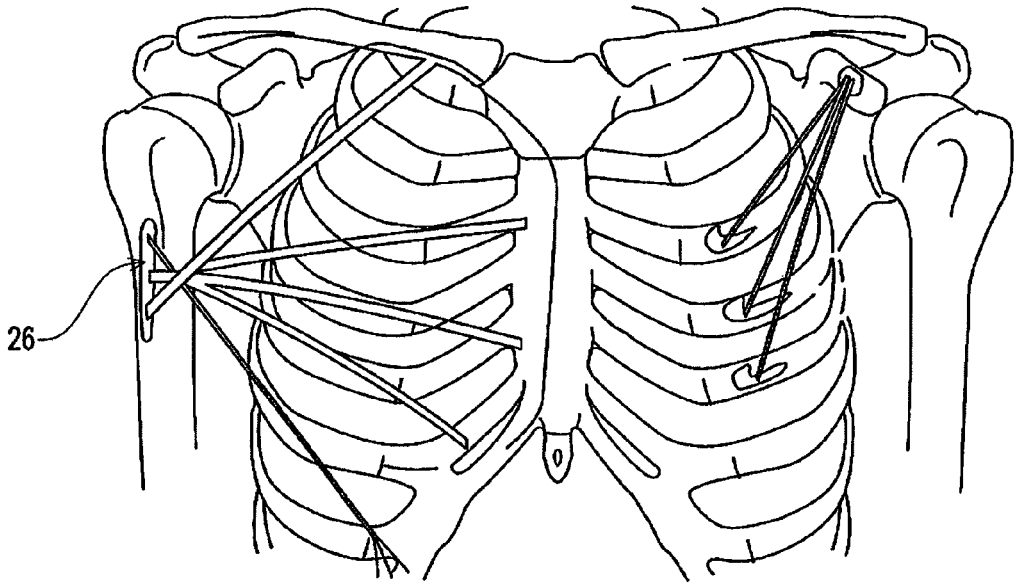
FIG. 6 is a skeletal diagram showing the upper half of the human body.
Figure 7:
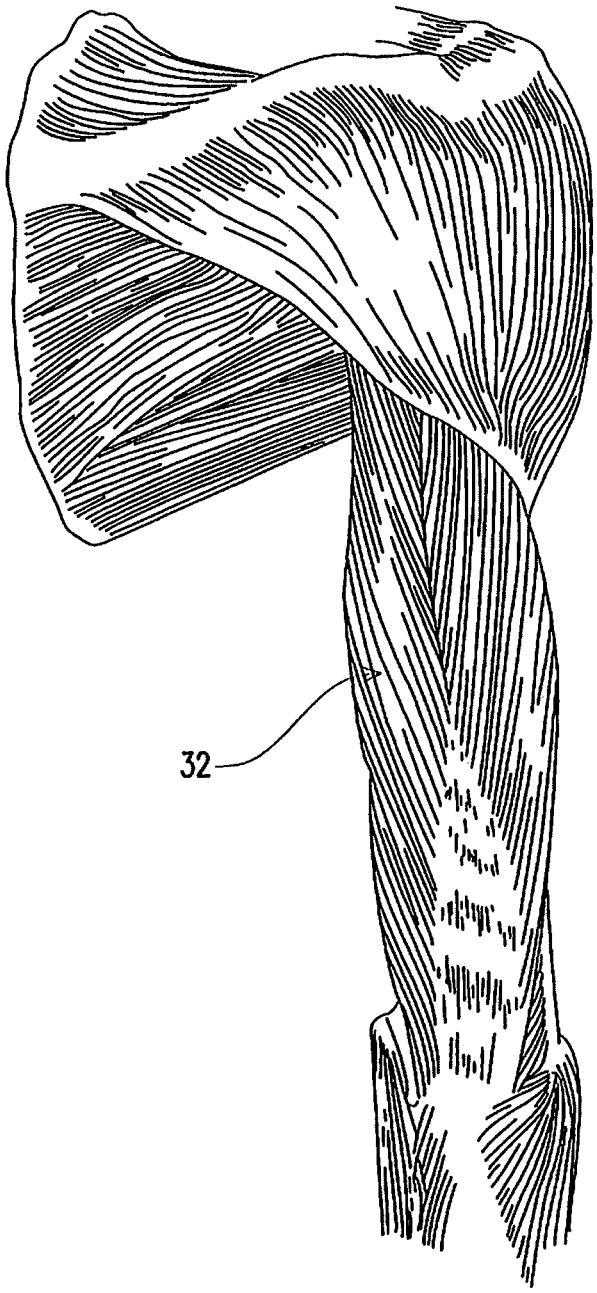
FIG. 7 is a rear view showing the upper arm of the human body.
Figure 8:
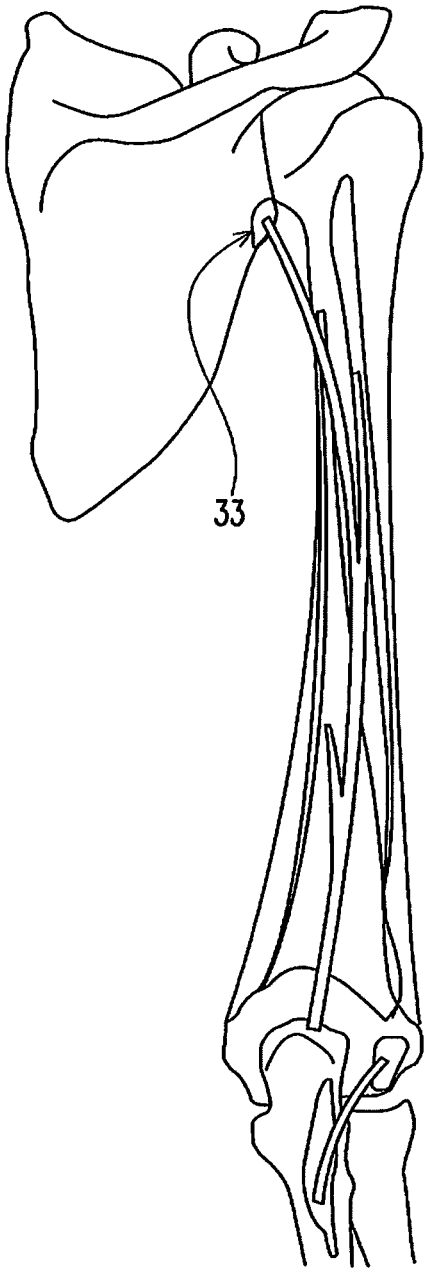
FIG. 8 is a skeletal diagram showing the upper arm of the human body.

The front body 2 and the back body 3 shown in FIGS. 1, 3, and 4 are shown as halves separated by a center line passing through a center in the widthwise direction. The other halves are not shown in the figures. The front body 2 and the back body 3 shown in FIGS. 1, 3, and 4 are portions worn on the left half of the body of a wearer. Each of the front body 2 and the back body 3 shown in FIGS. 1, 3, and 4 is bilaterally symmetric about its center line. In the following, the center line of the front body 2 is referred to as a front center line 15*a*, and the center line of the back body 3 is referred to as a back center line 15*b*.

In the present embodiment, the front center line 15*a* and the back center line 15*b* are shown as imaginary lines. These center lines are not necessarily shown in actual bodies 2 and 3. In some case, however, these center lines are shown in the patterns of the bodies 2 and 3. The same can also be said about various center lines described below.

As shown in FIG. 1, the front armhole line 9*a* of the first portion to be sewn 6 is a curve concaved toward the center (front center line 15*a*) of the front body 2 in the widthwise direction of the front body 2 between its upper and lower ends. The position in the first portion to be sewn 6 of the front body 2 concaved most largely between the upper and lower ends is a reference position at the time of sewing of the sleeve 4. This reference position is referred to as a first sewing reference position 21 below.

The first sewing reference position 21 is positioned nearest to the center (front center line 15*a*) of the front body 2 in the widthwise direction of the front body 2 in the first portion to be sewn 6. Also, the first sewing reference position 21 is set in correspondence with the crest of greater tubercle (the portion indicated by reference numeral 26 in FIG. 6) of a wearer to which the greater pectoral muscle (indicated by reference numeral 25 in FIG. 5) inserts.

As shown in FIG. 1, the back armhole line 9*b* of the second portion to be sewn 12 is a curve concaved toward the center (back center line 15*b*) of the back body 3 in the widthwise direction of the back body 3 between its upper and lower ends. The position in the second portion to be sewn 12 of the back body 3 concaved most largely between the upper and lower ends is a reference position at the time of sewing of the sleeve 4. This reference position is referred to as a second sewing reference position 31 below.

The second sewing reference position 31 is positioned nearest to the center (back center line 15*b*) of the back body 3 in the widthwise direction of the back body 3 in the second portion to be sewn 12. The second sewing reference position 31 is set in correspondence with the infraglenoid tubercle of the blade bone (indicated by reference numeral 33 in FIG. 8) of the wearer in which the long head of the triceps brachii muscle (indicated by reference numeral 32 in FIG. 7) originates.

Referring again to FIG. 1, the front body 2 and the back body 3 are shown in a state in which the side lines 10 thereof coincide with each other. In this state, the front armhole line 9*a* of the first portion to be sewn 6 of the front body 2 and the back armhole line 9*b* of the second portion to be sewn 12 of the back body 3 are formed so as to connect continuously to each other. The front armhole line 9*a* and the back armhole line 9*b* form a recess concaved downward (in a direction from the neckline toward the bottom).

A recess formed by integrally combining the first portion to be sewn 6 and the second portion to be sewn 12 in this way is generally called an armhole AH. The length of the armhole AH is equal to the sum of the length of the first portion to be sewn 6 (the length of the front armhole line 9*a*) and the length of the second portion to be sewn 12 (the length of the back armhole line 9*b*). The lowest end of the armhole AH, i.e., a lowermost bottom portion of the recess is generally called a "kamazoko" (indicated by reference numeral 35). The kamazoko 35 is positioned on the side line 10 in the state where the front body 2 and the back body 3 are sewn to each other.

As shown in FIG. 1, when an imaginary straight line 17 connecting the kamazoko 35 and the shoulder point SP is drawn on the front body 2, the front armhole line 9*a* representing the first portion to be sewn 6 of the front body 2 is positioned nearer to the center (front center line 15*a*) of the front body 2 in the widthwise direction relative to the straight line 17. Also, the front armhole line 9*a* is formed into a concave shape concaved from the straight line 17 toward the center (front center line 15*a*) of the front body 2 in the widthwise direction by being curved in circular-arc form. The first sewing reference position 21 is positioned nearer to the center (front center line 15*a*) of the front body 2 in the widthwise direction relative to the straight line 17.

When a front portion to be sewn 54 of the sleeve 4 is sewn to the first portion to be sewn 6 of the front body 2, part of the sleeve 4 occupies the region surrounded by the front armhole line 9*a* and the straight line 17 connecting the kamazoko 35 and the shoulder point SP on the front body 2.

Also, as shown in FIG. 1, when an imaginary straight line 18 connecting the kamazoko 35 and the shoulder point SP is drawn on the back body 3, the front armhole line 9*b* representing the second portion to be sewn 12 of the back body 3 is positioned nearer to the center (back center line 15*b*) of the back body 3 in the widthwise direction relative to the straight line 18. Also, the back armhole line 9*b* is formed into a concave shape concaved from the straight line 18 toward the center (back center line 15*b*) of the back body 3 in the widthwise direction by being curved in circular-arc form. The second sewing reference position 31 on the second portion to be sewn 12 is positioned nearer to the center (back center line 15*b*) of the back body 3 in the widthwise direction relative to the straight line 18.

When a back portion to be sewn 55 of the sleeve 4 is sewn to the second portion to be sewn 12 of the back body 3, part of the sleeve 4 occupies the region surrounded by the back armhole line 9*b* and the straight line 18 connecting the kamazoko 35 and the shoulder point SP on the back body 3.

If the length of the first portion to be sewn 6 (the length of the front armhole line 9*a*) is L1, and if the length from the shoulder point SP to the first sewing reference position 21 on the front body 2 is L2, it is desirable that the condition within a range of $0.45\,L1 \leq L2 \leq 0.55\,L1$ be satisfied. By satisfying this condition, a portion of the sleeve 4 (a portion in the vicinity of a vertex 67 of a front sleeve attachment line 60*a*) is disposed at a position corresponding to the crest of greater tubercle 26 at which the muscles move strongly (to cause expansion/contraction of the skin) in up/down and forward/backward movements of the arm, thereby enabling the sleeve 4 to follow these movements and enabling reducing the pull of the front body 2 from the sleeve 4. With respect to the first sewing reference position 21, if the condition within this range is satisfied, an error of about 2% in the length of the armhole AH, i.e., the sum of the length of the front armhole line 9*a* and the length of the back armhole line 9*b*, is allowed.

Also, if the length of the second portion to be sewn 12 (the length of the back armhole line 9*b*) is L3, and if the length from the shoulder point SP to the second sewing reference position 31 on the back body 3 is L4, it is desirable that the condition within a range of $0.35\,L3 \leq L4 \leq 0.45\,L3$ be satisfied. By satisfying this condition, a portion of the sleeve 4 (a portion in the vicinity of a vertex 72 of a back sleeve attachment line 60*b*) is disposed at a position corresponding to the infraglenoid tubercle 33 at which the muscles move strongly (to cause expansion/contraction of the skin) in up/down and forward/backward movements of the arm, thereby enabling the sleeve 4 to follow these movements and enabling reducing the pull of the back body 3 from the sleeve 4. With respect to the second sewing reference position 31, if the condition within this range is satisfied, an error of about 2% in the length of the armhole AH, i.e., the sum of the length of the front armhole line 9*a* and the length of the back armhole line 9*b*, is allowed.

As shown in FIG. 1, in the front body 2 and the back body 3 a chest line 37 is horizontally drawn so as to be tangent to the kamazoko 35. In the following, the chest line 37 drawn on the front body 2 is referred to as a front chest line 37*a*, and the chest line 37 drawn on the back body 3 is referred to as a back chest line 37*b*.

A chest guide line 41 passing through the first sewing reference position 21 and orthogonal to the front chest line 37*a* is drawn on the front body 2. A chest line 42 orthogonal to the chest guide line 41 is also drawn from the first sewing reference position 21 on the front body 2. Also, as shown in FIG. 1, a first auxiliary line 43 passing through the upper end of the neckline representing the edge of the neck of the front body 2 and orthogonal to the chest guide line 41 is drawn as an imaginarily line on the front body 2.

A back guide line 44 passing through the second sewing reference position 31 and orthogonal to the back chest line 37*b* is drawn on the back body 3. A back line 45 orthogonal to the back guide line 44 is also drawn from the second sewing reference position 31 on the back body 3. Also, as shown in FIG. 1, a second auxiliary line 46 passing through the upper end of the back neckline 7*b* representing the edge of the neck of the back body 3 and orthogonal to the back center line 15*b* of the back body 3 is drawn as an imaginarily line on the back body 3. The second auxiliary line 46 is extended to the front body 2 side to reach the front center line 15*a* of the front body 2. The second auxiliary line 46 orthogonally intersects the front center line 15*a*.

Figure 2:
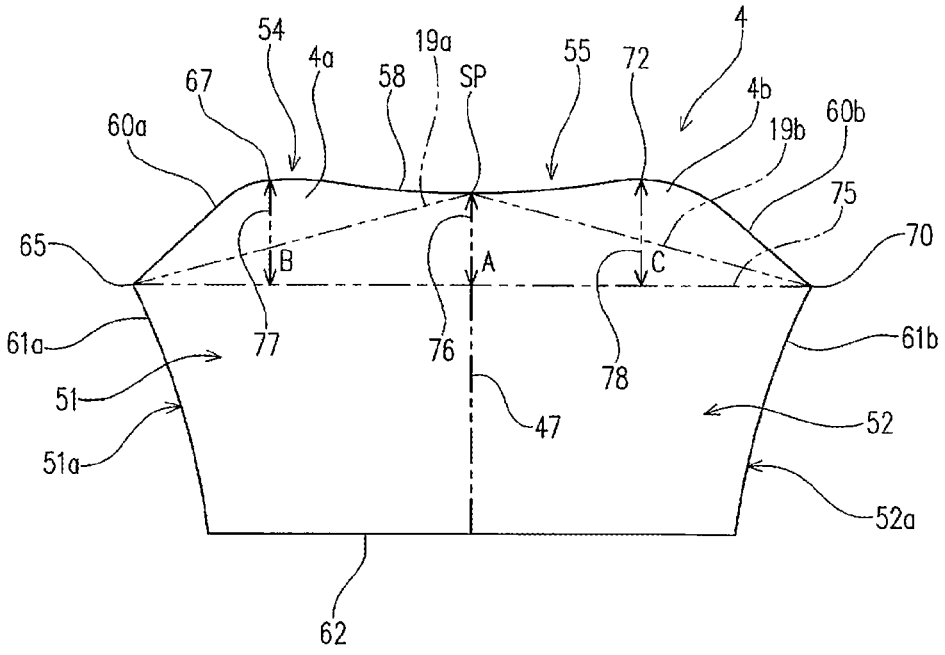
FIG. 2 is a developed view of a sleeve.

In a state of being unfolded as shown in FIG. 2, the sleeve 4 is divided into a front sleeve portion 51 to be sewn to the front body 2 and a back sleeve portion 52 to be sewn to the back body 3 by a sleeve head seam line 47 passing through a center of the sleeve 4 in the widthwise direction. That is, the sleeve head seam line 47 is a boundary line separating the front sleeve portion 51 and the back sleeve portion 52 from each other.

The front sleeve portion 51 has a front portion to be sewn 54, which is sewn to the first portion to be sewn 6 of the front body 2. An end portion (hereinafter referred to as a "first end portion to be sewn) 51*a* of the front sleeve portion 51 at an end in the widthwise direction is sewn to the back sleeve portion 52.

The back sleeve portion 52 has a back portion to be sewn 55, which is sewn to the second portion to be sewn 12 of the back body 3. An end portion (hereinafter referred to as a "second end portion to be sewn) 52*a* of the back sleeve portion 52 at an end in the widthwise direction is sewn to the front sleeve portion 51.

The sleeve 4 is formed so as to be tubular by sewing together the first portion to be sewn 51*a* of the front sleeve portion 51 and the second portion to be sewn 52*a* of the back sleeve portion 52. The sleeve 4 made tubular has a sleeve mouth 57 at its one end in the tube axis direction and a portion at the other end sewn to the front body 2 and the back body 3.

The front portion to be sewn 54 in the front sleeve portion 51 and the back portion to be sewn 55 in the back sleeve portion 52 are formed so as to connect continuously to each other. That is, the front sleeve attachment line 60*a* representing the edge of the front portion to be sewn 54 and the back sleeve attachment line 60*b* representing the edge of the back portion to be sewn 55 are formed so as to connect continuously to each other.

The boundary between the front portion to be sewn 54 and the back portion to be sewn 55 is positioned on the sleeve head seam line 47 of the sleeve 4. This boundary is the shoulder point SP corresponding to the outer end of the shoulder of a wearer when the sleeve 4 is sewn to the front body 2 and the back body 3. The sleeve 4 is sewn to the front body 2 and to the back body 3 so that this shoulder point SP coincides with the shoulder point SP on the front body 2 and the back body 3. This shoulder point SP corresponds, at the center of the sleeve 4 in the widthwise direction, to a bottommost portion in a recess 58 formed by the front sleeve attachment line 60*a* and the back sleeve attachment line 60*b*.

As shown in FIG. 2, the sleeve 4 is defined with the front sleeve attachment line 60*a* representing the edge of the front portion to be sewn 54, the back sleeve attachment line 60*b* representing the edge of the back portion to be sewn 55, a front sleeve bottom line 61*a* representing the first end portion to be sewn 51*a* of the front sleeve portion 51, a back sleeve bottom line 61*b* representing the second end portion to be sewn 52*a* of the back sleeve portion 52, and a sleeve mouth line 62 representing the edge of the sleeve mouth 57.

The front sleeve bottom line 61*a* and the back sleeve bottom line 61*b* are formed by being slanted at predetermined angles from the sleeve head seam line 47. The sleeve 4 in the tubular state is thereby reduced in diameter with approach to the sleeve mouth 57.

One end of the front sleeve attachment line 60*a* representing the edge of the front portion to be sewn 54 coincides with the shoulder point SP. The other end of the front sleeve attachment line 60*a* is a boundary point (hereinafter referred to as a "first boundary point") 65 between the front sleeve attachment line 60*a* and the front sleeve bottom line 61*a*. The first boundary point 65 is a point representing the boundary between the first end portion to be sewn 51*a* and the front portion to be sewn 54 in the front sleeve portion 51. The front sleeve attachment line 60*a* is a curve projecting in the direction of extending away from the sleeve mouth 57 (FIG. 9), i.e., the direction of projection toward the front body 2, between the shoulder point SP and the first boundary point 65.

The front sleeve portion 51 at the position (hereinafter referred to as "the vertex of the front sleeve attachment line") 67 at which the front sleeve attachment line 60*a* projects most largely is sewn to the first sewing reference position 21 of the front body 2. The vertex 67 of the front sleeve attachment line 60*a* projects toward the front body 2 relative to the shoulder point SP.

The back sleeve attachment line 60*b* representing the edge of the back portion to be sewn 55 has one end coinciding with the shoulder point SP. The other end of the back sleeve attachment line 60*b* is a boundary point (hereinafter referred to as a "second boundary point") 70 between the back sleeve attachment line 60*b* and the back sleeve bottom line 61*b*. The second boundary point 70 is a point representing the boundary between the second end portion to be sewn 52*a* and the back portion to be sewn 55 in the back sleeve portion 52. The back sleeve attachment line 60*b* is a curve projecting in the direction of extending away from the sleeve mouth 57 (FIG. 9), i.e., the direction of projection toward the back body 3, between the shoulder point SP and the second boundary point 70.

The back sleeve portion 52 at the position (hereinafter referred to as "the vertex of the back sleeve attachment line") 72 at which the back sleeve attachment line 60*b* projects most largely is sewn to the back body 3 at the second sewing reference position 31. The vertex 72 of the back sleeve attachment line 60*b* projects toward the back body 3 relative to the shoulder point SP.

If, when a line (hereinafter referred to as a "sleeve width line") 75 connecting the first boundary point 65 and the second boundary point 70 is drawn, the length of a line 76 drawn from the shoulder point SP so as to be orthogonal to the sleeve width line 75 is A; and the length of a line 77 drawn from the vertex 67 of the front sleeve attachment line 60*a* so as to be orthogonal to the sleeve width line 75 is B, a relationship of $A<B$ is established.

Also, if the length of a line 78 drawn from the vertex 72 of the back sleeve attachment line 60*b* so as to be orthogonal to the sleeve width line 75 is C, a relationship of $A<C$ is established. Further, B and C may be in a relationship $B=C$. However, B and C may alternatively be set in a relationship $B<C$ by considering the fact that the range in which the arm can move in a forward direction is wider than the range in which the arm can move in a backward direction. The line 76 drawn from the shoulder point SP so as to be orthogonal to the sleeve width line 75 coincides with the sleeve width line 75.

Figure 9:
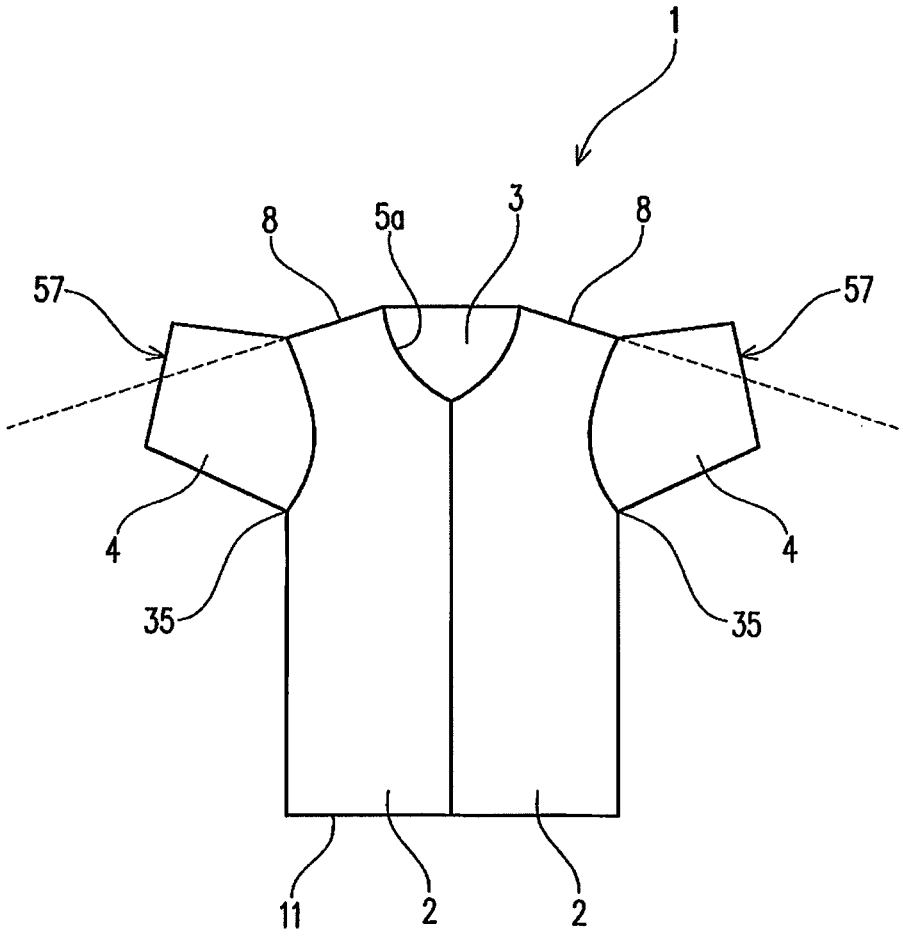
FIG. 9 is a front view of an upper garment.

As a result, when the upper garment 1 is manufactured by sewing the front body 2 and the back body 3 to each other and by sewing the sleeve 4 to these bodies, part of the sleeve 4 is positioned above a line extended from the shoulder line 8 of the front body 2 (back body 3), as shown in FIG. 9.

Also, it is desirable that if the length of the armhole AH is L5, the distance A from the shoulder point SP to the sleeve width line 75 be set within a range: $(1/8)\times L5-0.02\times L5\leq A\leq(1/8)\times L5+0.02\times L5$. In this way, the sleeve attachment line can be made smooth (so that the curve is not steep) to facilitate sewing and to reduce the occurrence of the puckering problem or the like.

Also, it is desirable that the distance B from the vertex 67 of the front sleeve attachment line 60*a* to the sleeve width line 75 and the distance C from the vertex 72 of the back sleeve attachment line 60*b* to the sleeve width line 75 be set within a range: $(1/8)\times L5-0.01\times L5\leq B<(1/8)\times L5+0.03\times L5$ and a range: $(1/8)\times L5-0.01\times L5\leq C\leq(1/8)\times L5+0.03\times L5$. In this way, the sleeve attachment line can be made smooth (so that the curve is not steep) to facilitate sewing and to reduce the occurrence of the puckering problem or the like.

As cloth for the sleeve 4, the front body 2 and the back body 3 of the upper garment 1, for example, stretchable one or non-stretchable one may be used as desired. If the upper garment 1 uses stretchable cloth at least for a portion including or in the vicinity of an underarm portion, a combination of ease enabling following the movement of the arm and the stretchability of the cloth facilitates following the movement of the arm.

In the upper garment 1 according to the first embodiment of the present invention as described above, the first sewing reference position 21 on the front body 2 is set nearest to the center of the front body 2 in the widthwise direction in the first portion to be sewn 6, and the point (the vertex 67 of the front sleeve attachment line 60*a*) to be sewn to the first portion to be sewn 6 in the front portion to be sewn 54 in the front sleeve portion 51 projects toward the front body 2 relative to the shoulder point of the sleeve 4, thereby enabling a portion in the vicinity of the vertex 67 of the front sleeve attachment line 60*a* in the front sleeve portion 51 to follow the movement of the arm when the wearer largely moves the arm backward. As a result, the front body 2 is not easily pulled by the sleeve 4 (front sleeve portion 51).

Description will be made in more detail with respect to this point. As described above, the first portion to be sewn 6 of the front body 2 is formed so as to be concave toward the front center line 15*a* relative to the straight line 17 connecting the kamazoko 35 and the shoulder point SP on the front body 2. Accordingly, part of the sleeve 4 occupies the region surrounded by the front armhole line 9*a* of the first portion to be sewn 6 and the straight line 17.

Referring to FIG. 2, when a straight line 19*a* connecting the shoulder point and the first boundary point 65 on the sleeve 4 is imaginarily drawn, the region surrounded as described above corresponds to a region surrounded by the straight line 19*a* and the front sleeve attachment line 60*a* (the portion corresponding to this region will be referred to as a "base portion of the sleeve on the front sleeve portion side" 4*a*).

In the present embodiment, the base portion 4*a* of the sleeve 4 on the front sleeve portion 54 side penetrates the front center line 15*a* side of the straight line 17 connecting the shoulder point SP and the kamazoko 35 on the front body 2. In this state the front portion to be sewn 54 is sewn to the first portion to be sewn 6. As a result, the base portion 4*a* of the sleeve 4 on the front sleeve portion 51 side occupies the region surrounded by the front armhole line 9*a* and the straight line 17 connecting the kamazoko 35 and the shoulder point SP on the front body 2.

Figure 21:
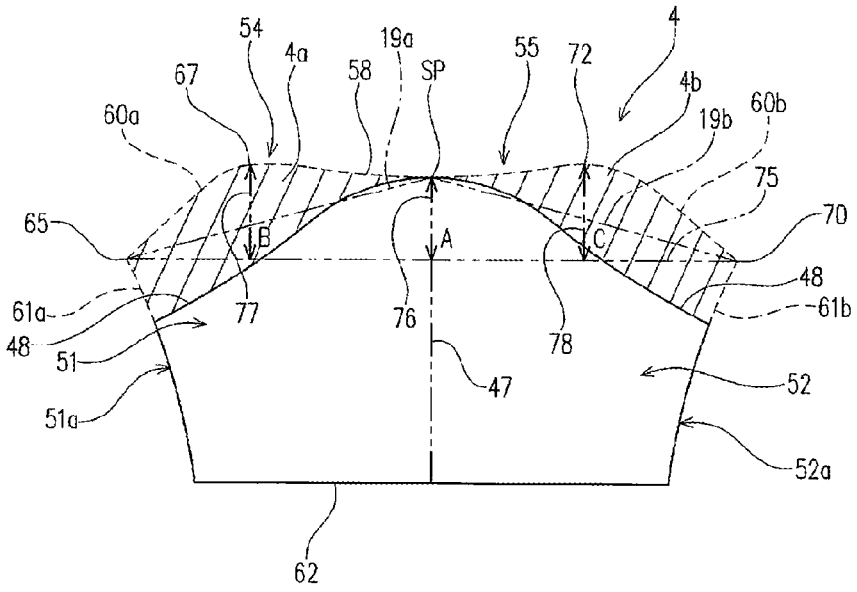
FIG. 21 is a developed view of a conventional set-in-type sleeve.

When the wearer largely swings the arm backward while wearing the upper garment 1, the base portion 4*a* of the sleeve 4 on the front sleeve portion 51 side absorbs the amount of movement of the sleeve 4 following this movement of the arm to prevent the front body 2 from being pulled by the sleeve 4. That is, the base portion 4*a* of the sleeve 4 on the front sleeve portion 51 side is formed with a little enlargement (ease) to be capable of following the movement of the sleeve 4 when the sleeve 4 is largely swung. As shown in FIG. 21, this ease is formed by largely projecting the sleeve attachment lines 60*a* and 60*b* to the body 2 and body 3 sides relative to the sleeve attachment lines (indicated by reference numeral 48) of a conventional sleeve. That is, in the present embodiment, the area of the sleeve is increased from that of the conventional sleeve by the area of the portion (hatched in FIG. 2) surrounded by the sleeve attachment line 48 of the conventional sleeve and the sleeve attachment lines 60*a* and 60*b* and the sleeve bottom lines 61*a* and 61*b* in the present embodiment. Ease is produced by this portion.

Thus, even when the wearer largely moves the arm backward, the base portion 4*a* of the sleeve 4 on the front sleeve portion 51 side in the upper garment 1 follows the movement of the sleeve 4, thereby reducing the pull of the front body 2 from the sleeve 4.

Moreover, the base portion 4*a* of the sleeve 4 on the front sleeve portion 51 side is formed in the upper garment 1 so that the base portion 4*a* can follow the movement of the sleeve 4 even when the wearer largely moves the arm up and down, thereby reducing the pull of the front body 2 from the sleeve 4.

Also, the first sewing reference position 21 on the front body 2 is set in correspondence with the crest of greater tubercle (the portion indicated by reference numeral 26 in FIG. 6) of the wearer to which the greater pectoral muscle (indicated by reference numeral 25 in FIG. 5) inserts, thereby enabling reducing the pull of the front body 2 from the sleeve 4 more effectively. That is, since the muscles move largely and strongly in the vicinity of the crest of greater tubercle 26, the placement of part of the sleeve 4 (a portion in the vicinity of the vertex 67 of the front sleeve attachment line 60*a*) at this position enables the sleeve 4 to follow this movement so that the pull of the front body 2 from the sleeve 4 is reduced.

Also, the second sewing reference position 31 on the back body 3 is positioned nearest to the center of the back body 3 in the widthwise direction in the second portion to be sewn 12, and the point (the vertex 72 of the back sleeve attachment line 60*b*) to be sewn to the second sewing reference position 31 on the second portion to be sewn 12 in the back portion to be sewn 55 in the back sleeve portion 52 is projected toward the back body 3 relative to the shoulder point SP on the sleeve 4 to enable a base portion 4*b* of the sleeve 4 on the back sleeve portion 52 side to follow the movement of the arm when the wearer moves the arm forward by inwardly bending the arm, thus reducing the pull of the back body 3 from the sleeve 4 (back sleeve portion 52).

This is achieved by providing an arrangement similar to that relating to the front body 2, such that the straight line 18 connecting the shoulder point SP and the kamazoko 35 on the back body 3 is drawn and part of the sleeve 4 occupies the region surrounded by the straight line 18 and the back armhole line 9*b*.

That is, referring to FIG. 2, when a straight line 19*b* connecting the shoulder point and the second boundary point 70 on the sleeve 4 is imaginarily drawn, the region surrounded as described above corresponds to a region surrounded by the straight line 19*b* and the back sleeve attachment line 60*b* (the portion corresponding to this region will be referred to as a "base portion of the sleeve on the back sleeve portion side" 4*b*).

In the present embodiment, the base portion 4*b* of the sleeve 4 on the back sleeve portion 55 side penetrates the back center line 15*b* side of the straight line 18 connecting the shoulder point SP and the kamazoko 35 on the back body 3. In this state the back portion to be sewn 55 is sewn to the second portion to be sewn 12. As a result, the base portion 4*b* of the sleeve 4 on the back sleeve portion 52 side occupies the region surrounded by the back armhole line 9*b* and the straight line 18 connecting the kamazoko 35 and the shoulder point SP on the back body 3.

When the wearer largely swings the arm forward while wearing the upper garment 1, the base portion 4*a* of the sleeve 4 on the back sleeve portion 52 side absorbs the amount of movement of the sleeve 4 following this movement of the arm to prevent the back body 2 from being pulled by the sleeve 4. That is, the base portion 4*b* of the sleeve 4 on the back sleeve portion 52 side is formed with a little enlargement (ease) to be capable of following the movement of the sleeve 4 when the sleeve 4 is largely swung.

Thus, even when the wearer largely moves the arm forward, the base portion 4*b* of the sleeve 4 on the back sleeve portion 52 side in the upper garment 1 follows the movement of the sleeve 4, thereby reducing the pull of the back body 2 from the sleeve 4.

Moreover, the base portion 4*b* of the sleeve 4 on the back sleeve portion 52 side is formed in the upper garment 1 so that the base portion 4*b* can follow the movement of the sleeve 4 even when the wearer largely moves the arm up and down, thereby reducing the pull of the back body 3 from the sleeve 4.

Also, because of the provision on the infraglenoid tubercle 33 of the blade bone of the wearer in which the long head of the triceps brachii muscle originates, it is possible to reduce the pull of the back body 3 from the sleeve 4 more effectively. That is, since the muscles move largely and strongly in the vicinity of the infraglenoid tubercle 33, the placement of part of the sleeve 4 (a portion in the vicinity of the vertex 72 of the back sleeve attachment line 60*b*) at this position enables the sleeve 4 to follow this movement so that the pull of the back body 3 from the sleeve 4 can be reduced.

Further, since part of the sleeve 4 is positioned above a line extended from the shoulder line 8 of the body (front body 2, back body 3), the amount of movement of the sleeve 4 when the arm is moved upward is reduced, thereby reducing the pull of the front body 2 from the front sleeve portion 51.

Figure 10A:
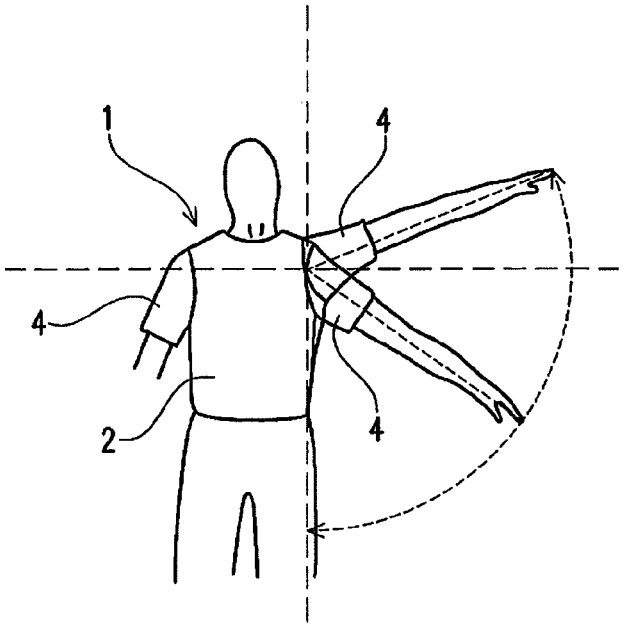
FIGS. 10(*a*) and 10(*b*) show a state in which a wearer wears an upper garment and moves his/her arm up and down.
Figure 10B:
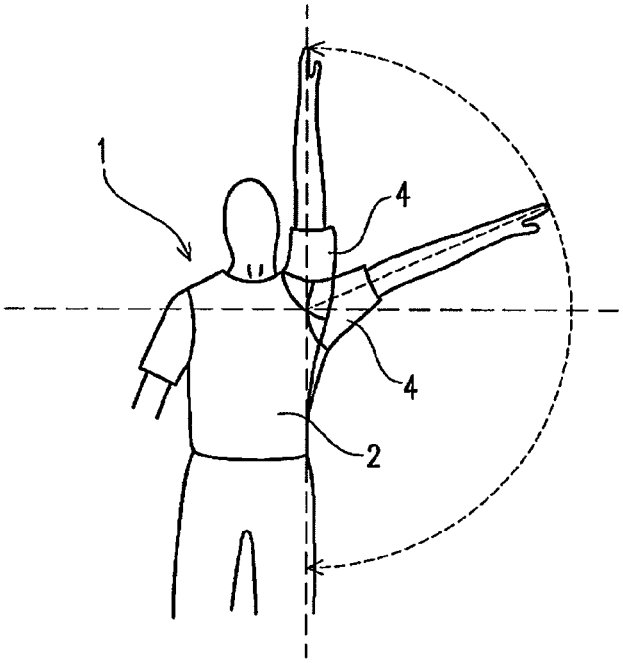
Figure 11A:
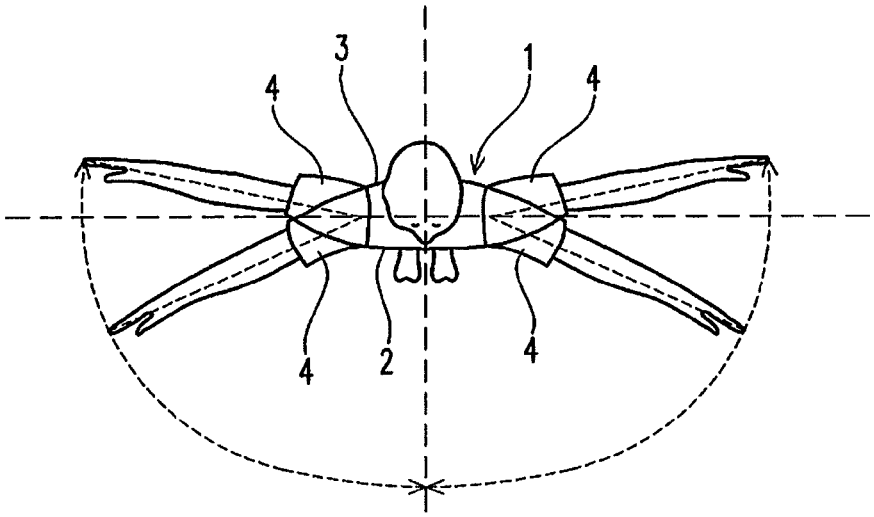
FIGS. 11(*a*) and 11(*b*) show a state in which a wearer wears an upper garment and moves his/her arm up forward and backward.
Figure 11B:
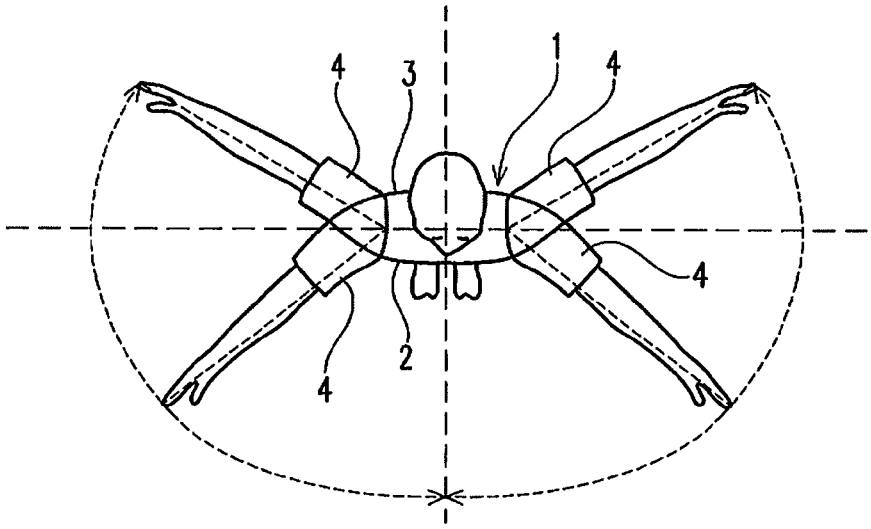

Thus, if a comparison is made between a case where a wearer wears the conventional upper garment 1 as shown in FIGS. 10(*a*) and 11(*a*) and a case where a wearer wears the upper garment 1 according to the present embodiment as shown in FIGS. 10(*b*) and 11(*b*), the pull of the body from the sleeve 4 can be reduced more largely in the case of wearing the upper garment 1 according to the present embodiment even when the arm is largely swung up, down, upward or backward. The upper garment 1 thus enables swing of the arm according to a wearer's intension, for example, in doing various athletic sports, activities or the like.

Also, the upper garment 1 has underarm portions formed only by the front body 2, the back body 3 and the sleeves 4, has the first portion to be sewn 6 of the front body 2, the front portion to be sewn 54 in the front sleeve portion 51, the second portion to be sewn 12 of the back body 3 and the back portion to be sewn 55 in the back sleeve portion 52, is provided with no separate parts including a gusset, can be provided with ease in a base portion of the sleeve 4, and is, therefore, capable of reducing the cost and labor.

Further, the upper garment 1 can be provided with ease in a base portion of the sleeve 4 without performing working for tucks, pleats or the like between the first portion to be sewn 6 of the front body 2 and the front portion to be sewn 54 in the front sleeve portion 51 and between the second portion to be sewn 12 of the back body 3 and the back portion to be sewn 55 in the back sleeve portion 52, and is, therefore, capable of reducing the cost and labor.

FIGS. 12 to 16 show a second embodiment of the upper garment 1. A raglan-type upper garment 1 will be described as the second embodiment by way of example.

The shapes of a front body 2, a back body 3 and sleeves 4 in the second embodiment are different from those in the first embodiment. While the shoulder line 8 is provided on the front body 2 in the above-described first embodiment, no shoulder line 8 is provided on the front body 2 in the second embodiment. In the front body 2, the upper end of the first portion to be sewn 6 to which the sleeve 4 (front sleeve portion 51) is sewn reaches the neck. Similarly, no shoulder line 8 is provided on the back body 3. In the back body 3, the upper end of the second portion to be sewn 12 to which the sleeve 4 (back sleeve portion 52) is sewn reaches the neck.

Also, while each of the upper end of the first portion to be sewn 6 of the front body 2 and the upper end of the second portion to be sewn 12 of the back body 3 is a shoulder point SP, the shoulder point SP is provided at a position separate from these upper ends in the present embodiment.

Also in the present embodiment, the sleeve 4 is divided into a front sleeve portion 51 and a back sleeve portion 52 by a sleeve head seam line 47, as is that in the first embodiment. The front sleeve portion 51 has a front portion to be sewn 54, which is sewn to the front body 2, as does the front sleeve portion 51 in the first embodiment. The back sleeve portion 52 has a back portion to be sewn 55, which is sewn to the back body 3, as does the back sleeve portion 52 in the first embodiment.

Figure 12:
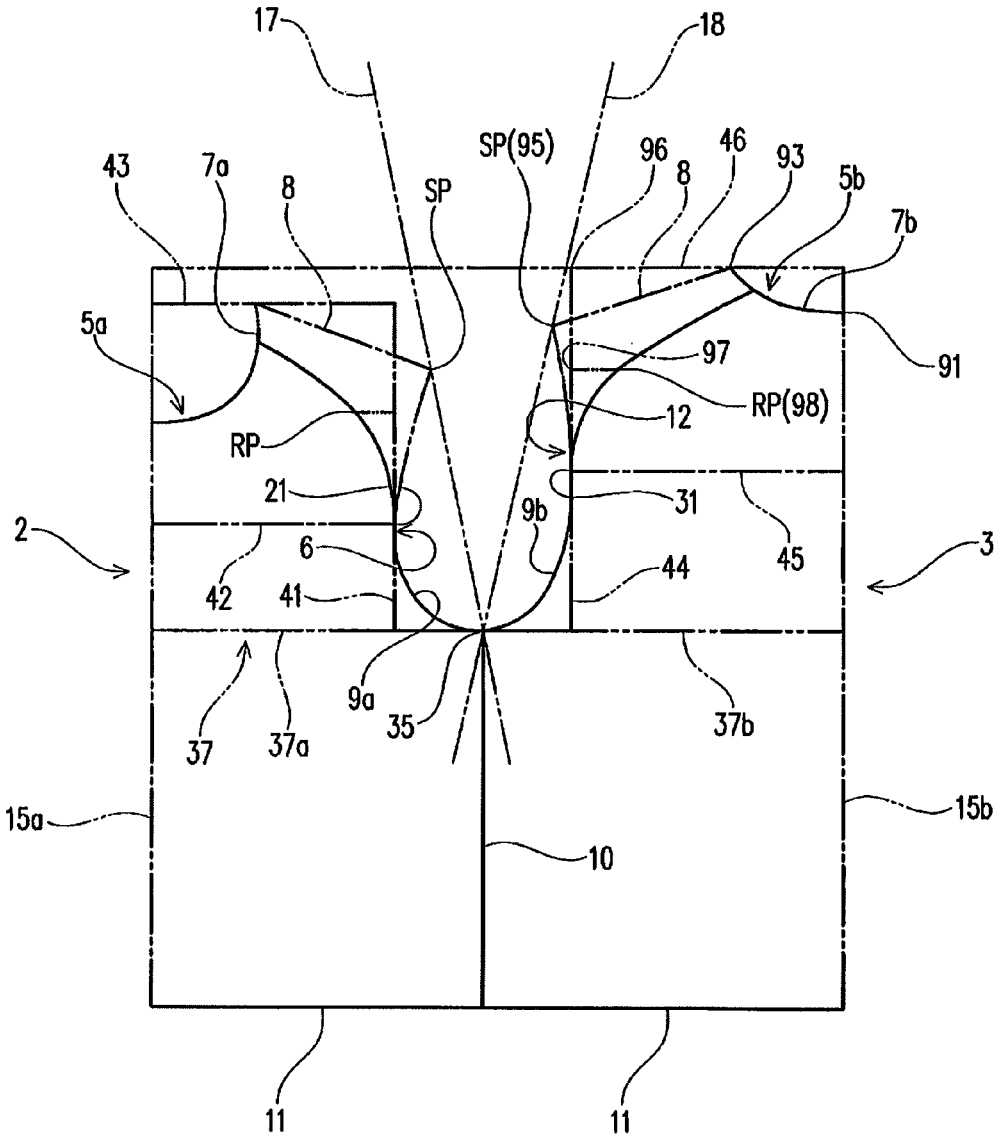
FIG. 12 is a developed view of a combination of a half of a front body and a half of a back body, showing a second embodiment.
Figure 13:
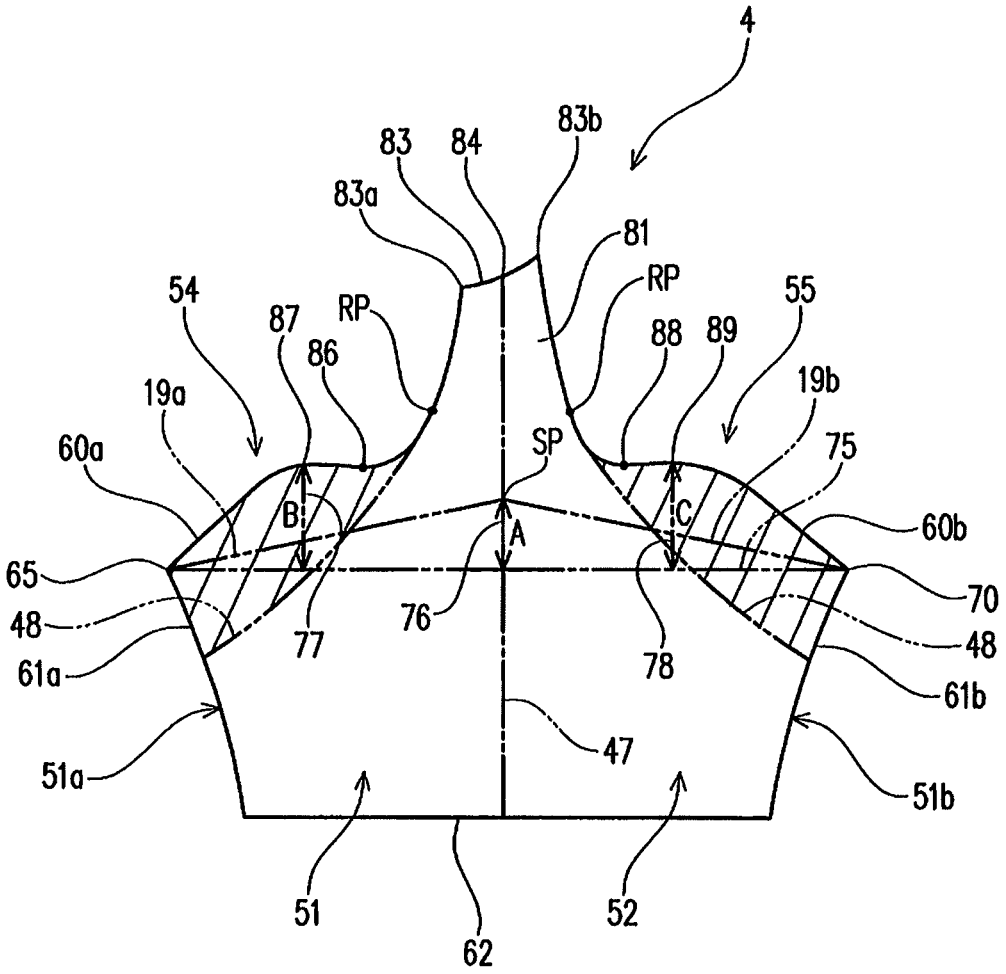
FIG. 13 is a developed view of a sleeve.
Figure 14:
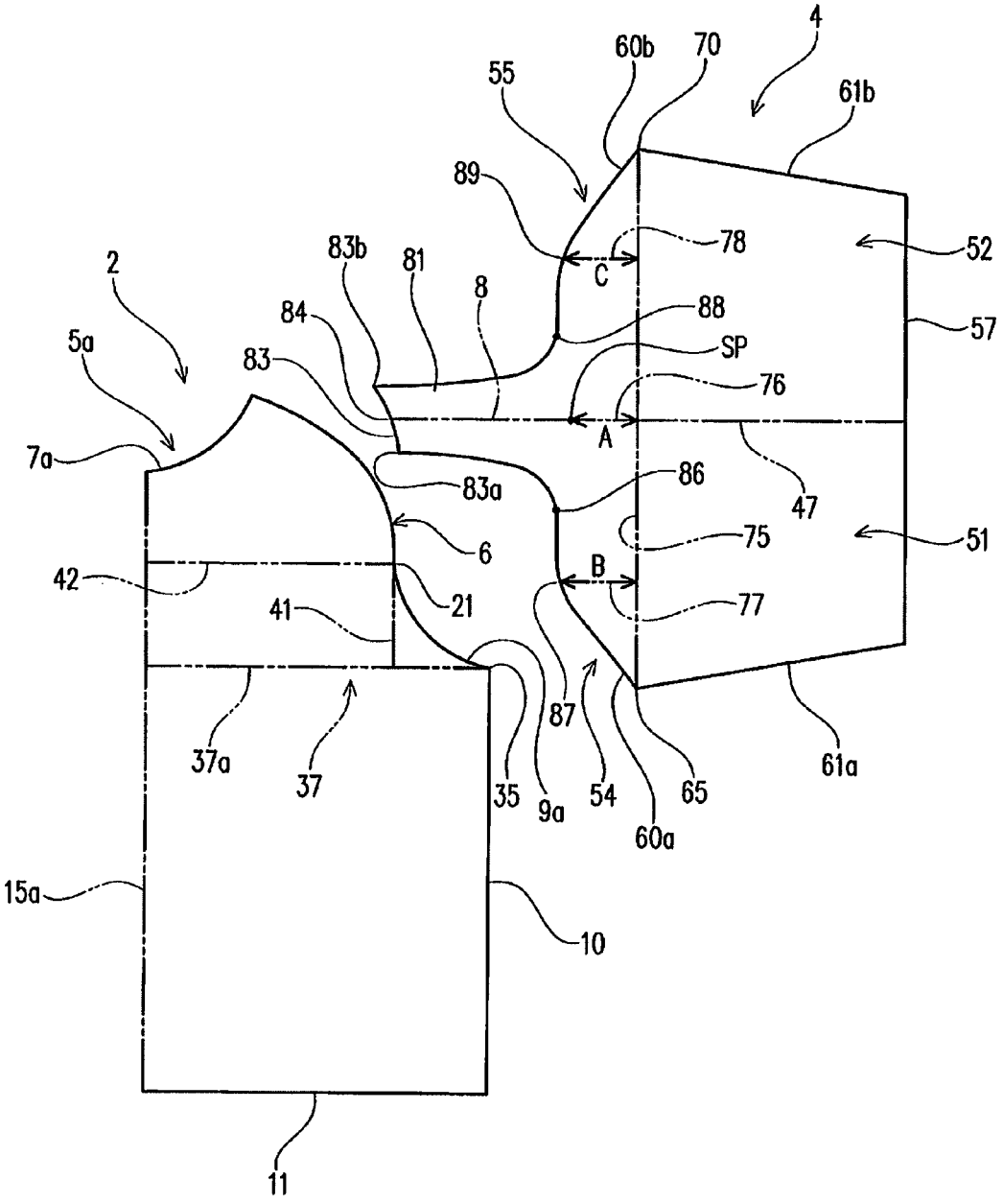
FIG. 14 is a developed view showing the front body and the sleeve.
Figure 15:
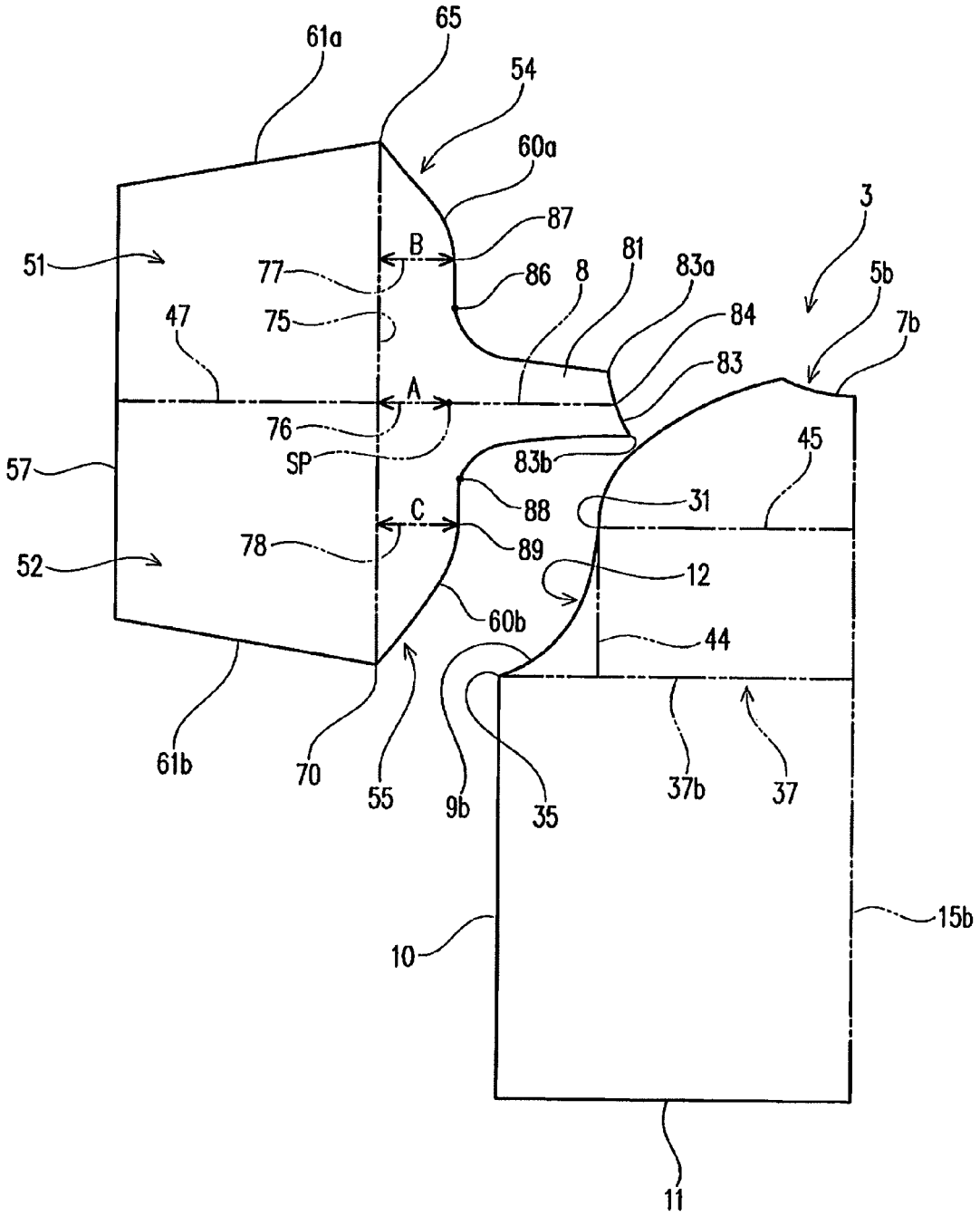
FIG. 15 is a developed view showing the back body and the sleeve.
Figure 16:
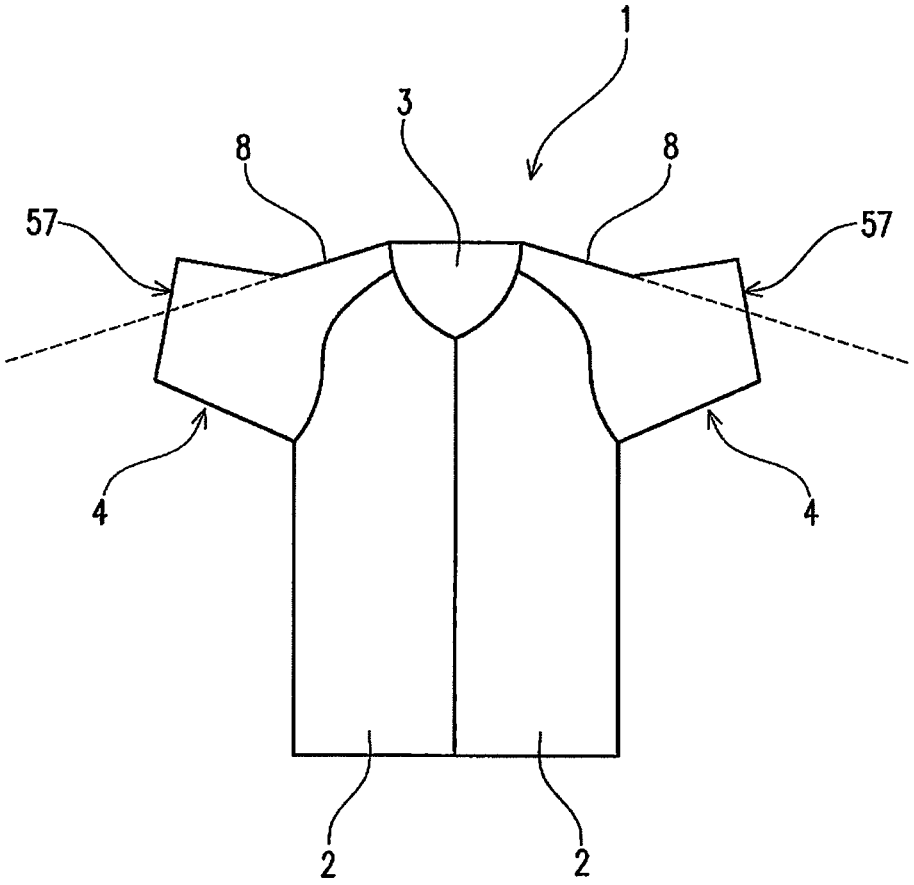
FIG. 16 is a front view of the upper garment.
Figure 17:
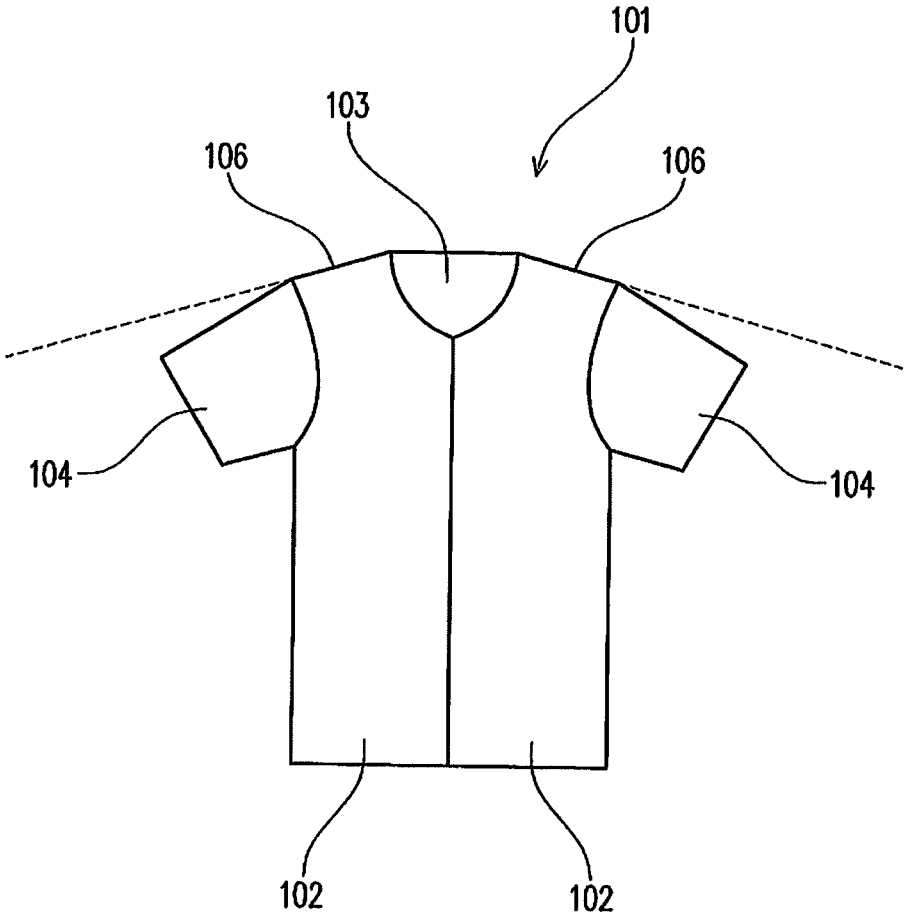
FIG. 17 is a front view showing a conventional set-in-type upper garment.
Figure 18:
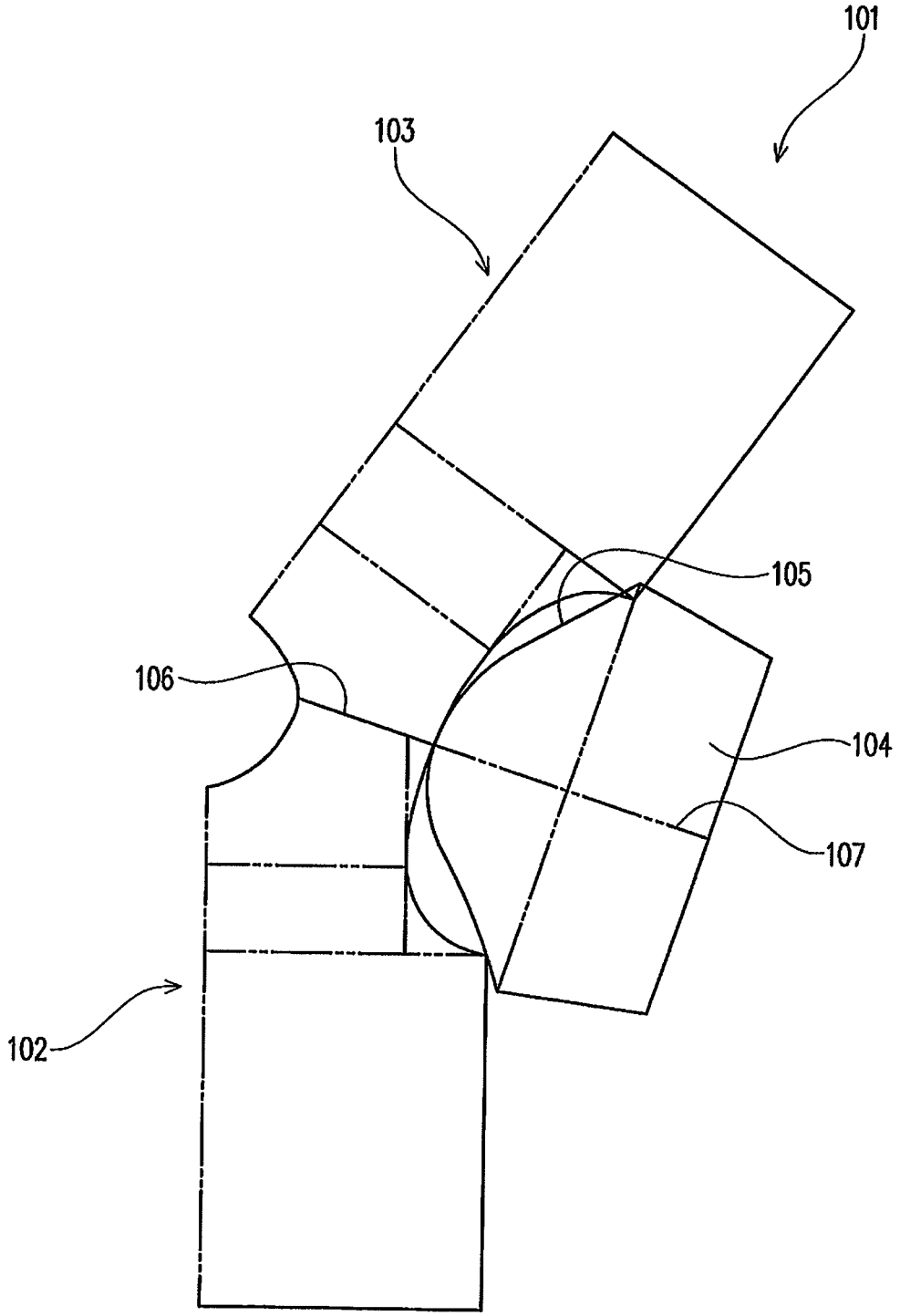
FIG. 18 is a developed view showing the front body, the back body and the sleeve of the conventional set-in-type upper garment.
Figure 19:
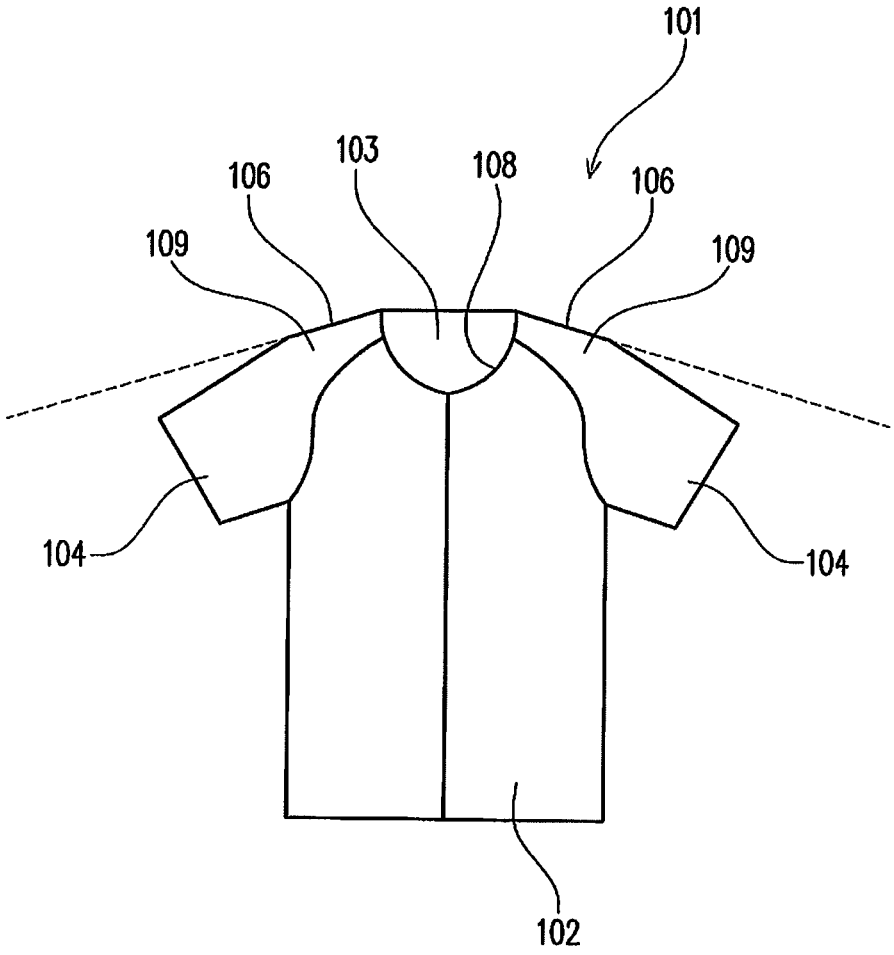
FIG. 19 is a front view showing a conventional raglan-type upper garment.
Figure 20:
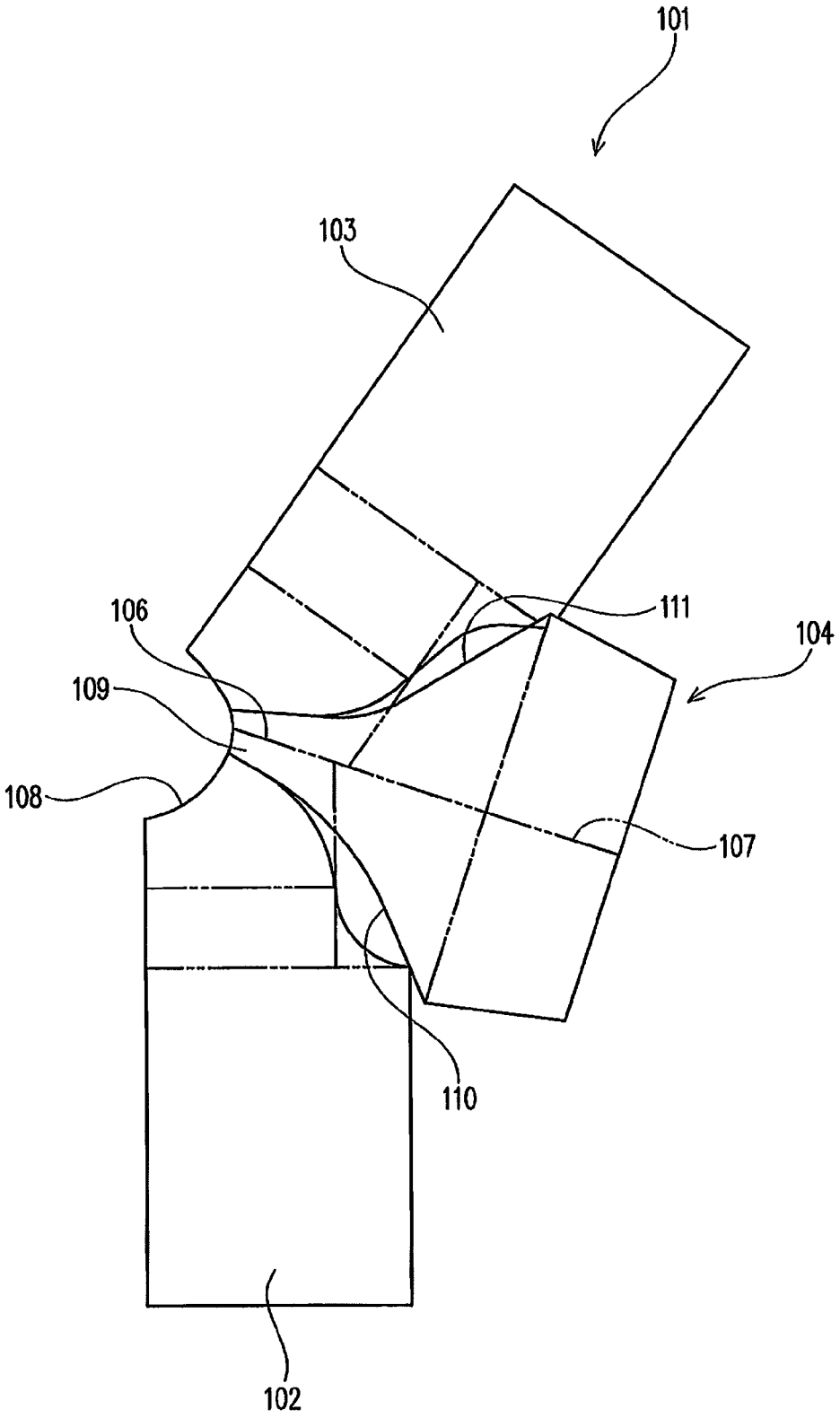
FIG. 20 is a developed view showing the front body, the back body and the sleeve of the conventional raglan-type upper garment.

In the present embodiment, as shown in FIGS. 12 and 13, the sleeve 4 has, at its center in the widthwise direction, a projecting portion 81 projecting toward the neck of the front body 2 and the back body 3. Since the projecting portion 81 is provided at the center of the sleeve 4 in the widthwise direction, it is divided into two portions by the sleeve head seam line 47. One of the two portions divided by the sleeve head seam line 47 forms part of the front portion to be sewn 54 in the front sleeve portion 51, and the other of the two portions forms part of the back portion to be sewn 55 in the back sleeve portion 52.

Also in the present embodiment, the first sewing reference position 21 described with respect to the first embodiment is set in the front portion to be sewn 54 of the front body 2, and the second sewing reference position 31 described with respect to the first embodiment is set in the back portion to be sewn 55 of the back body 3.

A portion of the projecting portion 81 of the sleeve 4 from the projecting end to the shoulder point SP contacts the shoulder of a wearer, while a portion from the shoulder point SP to its base portion contacts the arm (upper arm) of the wearer.

Also, the projecting end of the projecting portion 81 forms part of the neck. This projecting end is referred as a neck forming portion 83 below. The neck forming portion 83 intersects the sleeve head seam line 47 by its intermediate portion (the point of this intersection is indicated by reference numeral 84).

The front portion to be sewn 54 in the front sleeve portion 51 is formed in an area from the first boundary point 65 described with respect to the first embodiment to one end of the neck forming portion 83 (an end 51*a* on the front sleeve portion 51 side). A front sleeve attachment line 60*a* formed of a predetermined curve is formed as the edge of the front portion to be sewn 54.

The front sleeve attachment line 60*a* is represented by a three-order curve in a state where the sleeve 4 is unfolded as shown in FIG. 13. More specifically, if the sleeve width line 75 of the sleeve 4 and the sleeve head seam line 47 are assumed to represent X-coordinates and Y coordinates, respectively, in FIG. 13, the front sleeve attachment line 60*a* is a curve having a point corresponding to a minimum Y-coordinate (indicated by reference numeral 86 in FIG. 13) and a point corresponding to a maximum Y-coordinate (indicated by reference numeral 87 in FIG. 13) between the first boundary point 65 and the neck forming portion 83.

This minimum point 86 is positioned nearer to the center of the front body 2 in the widthwise direction (front center line 15*b*) relative to the shoulder point SP when the front portion to be sewn 54 in the front sleeve portion 51 is sewn to the first portion to be sewn 6 of the front body 2. In the present embodiment, the minimum point 86 on the front sleeve attachment line 60*a* is a point for discrimination of the projecting portion 81 in the front sleeve portion 51.

That is, in the present embodiment, the portion from the projecting end of the projecting portion 81 to the minimum point 86 on the front sleeve attachment line 60*a* forms the projecting portion 81. The position of the minimum point 86 is referred to as a "base portion in the projecting portion on the front sleeve portion side" below. The same reference numeral 86 as that for the minimum point is used for the base portion 86 in the projecting portion 81 on the front sleeve portion 51 side below.

In the projecting portion 81, the edge of the portion from the one end 83*a* of the neck forming portion 83 to the base portion 86 in the projecting portion 81 on the front sleeve portion 51 side is sewn to the first portion to be sewn 6 of the front body 2. That is, this portion in the projecting portion 81 is sewn to the front body 2 integrally with the front portion to be sewn 54.

The maximum point 87 on the front sleeve attachment line 60*a* is provided between the first boundary point 65 and the base portion 86 in the projecting portion 81 on the front sleeve portion 51 side. The front sleeve portion 51 is formed so that the position (portion) of the maximum point 87 projects toward the front body 2 relative to the shoulder point SP on the sleeve 4.

The front sleeve portion 51 is sewn at the position of the maximum point 87 on the front sleeve attachment line 60*a* to the first sewing reference position 21 set on the first portion to be sewn 6 of the front body 2. That is, the portion in the front sleeve portion 51 projecting to the front body 2 side relative to the shoulder point SP and projecting to the front body 2 side most largely between the base portion 86 in the projecting portion 81 on the front sleeve portion 51 side and the first boundary point 65 is sewn to the first sewing reference position 21.

While the front portion to be sewn 54 in the front sleeve portion 51 is formed in the area from the first boundary point 65 described with respect to the first embodiment to the one end 83*a* of the neck forming portion 83, the back portion to be sewn 55 in the back sleeve portion 52 is formed in an area from the second boundary point 70 described with respect to the first embodiment to the other end 83*b* of the neck forming portion 83. A back sleeve attachment line 60*b* formed of a predetermined curve is formed at the edge of the back portion to be sewn 55.

The back sleeve attachment line 60*b* is represented by a three-order curve in a state where the sleeve 4 is unfolded as shown in FIG. 13. More specifically, if the sleeve width line 75 of the sleeve 4 and the sleeve head seam line 47 are assumed to represent X-coordinates and Y coordinates, respectively, in FIG. 13, the back sleeve attachment line 60*b* is a curve having a point corresponding to a minimum Y-coordinate (indicated by reference numeral 88 in FIG. 13) and a point corresponding to a maximum Y-coordinate (indicated by reference numeral 89 in FIG. 13) between the second boundary point 70 and the neck forming portion 83.

This minimum point 88 is positioned nearer to the center of the back body 3 in the widthwise direction (back center line 15*b*) relative to the shoulder point SP when the back portion to be sewn 55 in the back sleeve portion 52 is sewn to the second portion to be sewn 12 of the front body 2. In the present embodiment, the minimum point 88 on the back sleeve attachment line 60*b* is a point for discrimination of the projecting portion 81 in the back sleeve portion 52.

That is, in the present embodiment, the portion from the projecting end of the projecting portion 81 to the minimum point 88 on the back sleeve attachment line 60*b* forms the projecting portion 81. The position of the minimum point 88 is referred to as a "base portion in the projecting portion on the back sleeve portion side" below. The same reference numeral 88 as that for the minimum point is used for the base portion in the projecting portion 81 on the back sleeve portion 52 side below.

In the projecting portion 81, the edge of the portion from the other end 83*b* of the neck forming portion 83 to the base portion 88 in the projecting portion 81 on the back sleeve portion 52 side is sewn to the second portion to be sewn 12 of the back body 3. That is, this portion in the projecting portion 81 is sewn to the back body 3 integrally with the front portion to be sewn 54.

The maximum point 89 on the back sleeve attachment line 60*b* is provided between the second boundary point 70 and the base portion 88 in the projecting portion 81 on the back sleeve portion 52 side. The back sleeve portion 52 is formed so that the position (portion) of the maximum point 89 projects toward the back body 3 relative to the shoulder point SP on the sleeve 4.

The back sleeve portion 52 is sewn at the position of the maximum point 89 on the back sleeve attachment line 60*b* to the second sewing reference position 31 set on the second portion to be sewn 12 of the back body 3. That is, the portion in the back sleeve portion 52 projecting to the back body 3 side relative to the shoulder point SP and projecting to the back body 3 side most largely between the base portion 88 in the projecting portion 81 on the back sleeve portion 52 side and the second boundary point 70 is sewn to the second sewing reference position 31.

In the first embodiment, the shoulder point SP indicated on the sleeve 4 is positioned at the bottom of the recess 58 formed by the front sleeve attachment line 60*a* and the back sleeve attachment line 60*b*. In the present embodiment, the shoulder point SP is positioned at an intermediate position in the projecting portion 81 and on the sleeve head seam line 47. The second embodiment differs from the first embodiment in this point.

The way of setting this shoulder point SP will be described below. For example, for the shoulder point SP of the sleeve 4, a shoulder point SP is set on the back body 3. In correspondence with this shoulder point SP on the back body 3, the shoulder point SP on the sleeve 4 is set.

A shoulder point SP is set on the back body 3 by taking measurements on the back body 3 on the basis of sizes set in advance with respect to the upper. garment 1. The sizes set in advance with respect to the upper garment 1 are, for example, a neck size corresponding to the size around the neck of the wearer who wears the upper garment 1, a chest size corresponding to the size around the chest of the wearer, a chest size of the front body 2 (front chest FC) corresponding to the chest size of the wearer, a chest size of the back body 3 (back chest BC) corresponding to the chest size of the wearer, the length of the armhole AH, and the length of the upper garment 1 between the top and the bottom.

To take measurements on the back body 3, the position of a base point 91 thereon is first determined. The base point 91 is the lowermost end of the neckline representing the edge of the neck of the back body 3 and the base point 91 is positioned on the back center line 15*b* of the back body 3. The back center line 15*b* is drawn on the basis of the base point 91, and the length of the garment is taken from the base point 91. By taking the length of the garment, the position of the bottom of the upper garment 1 (back body 3) is determined. The bottom is represented by a bottom line 11 orthogonal to the back center line 15*b*.

Next, the position of the kamazoko 35 is determined. The kamazoko 35 is set at a position at a predetermined distance away from the base point 91 along the back center line 15*b*. In ordinary cases, the length from the base point 91 to the kamazoko 35 is equal to ¼ of the chest size.

In the present embodiment, the kamazoko 35 is positioned higher than the ordinary position of the kamazoko 35 by 1/32 of the chest size. A chest line 37 passing through the kamazoko 35 and orthogonal to the back center line 15*b* (or the front center line 15*a*) is drawn on the back body 3 and the front body 2.

Referring to FIG. 12, a back line 45 is drawn at a position corresponding to a half of the length from the base point 91 to the kamazoko 35 so as to be orthogonal to the back center line 15*b*. The second sewing reference position 31 is a point of intersection of the back line 45 and the back armhole line 9*b* of the second portion to be sewn 12.

An upper end 93 of the back neck 5*b* is also determined on the basis of the base point 91. The upper end 93 of the back neck 5*b* is set at a predetermined distance away from the base point 91 in the direction along the back center line 15*b*. The distance (height) between the base point 91 and the upper end 93 of the back neck 5*b* along the back center line 15*b* is equal to 1/16 of the neck size.

Also, the upper end 93 of the back neck 5*b* is set at a predetermined distance away from the base point 91 in the widthwise direction (the direction along the back line 45). The distance (width) between the base point 91 and the upper end 93 of the back neck 5*b* in the widthwise direction is set to 3/16 of the neck size.

Referring to FIG. 12, a second auxiliary line 46 passing through the upper end 93 of the back neck 5*b* and orthogonal to the back center line 15*b* is drawn as an imaginarily line. Further, a shoulder line 8 slanting at a predetermined angle from the second auxiliary line 46 is drawn as an imaginary line. In the present embodiment, the interior angle between the second auxiliary line 46 and the shoulder line 8 is set to 17°.

The second sewing reference position 31 on the back body 3 is set at a predetermined distance away from the position of the boundary between the back armhole line 9*b* of the second portion to be sewn 12 and the front armhole line 9*a* of the first portion to be sewn 6 of the front body 2, i.e., from the kamazoko 35, in the widthwise direction of the back body 3 (the direction along the chest line 37). The distance between the kamazoko 35 and the second sewing reference position 31 in the widthwise direction of the back body 3 is equal to ⅛ of the chest size (back chest BC) of the back body 3.

On the back body 3, a back guide line 44 passing through the second sewing reference position 31 and orthogonal to the chest line 37 is drawn. One end of the back guide line 44 reaches the chest line 37, while the other end reaches the second auxiliary line 46. The second sewing reference position 31 is set at a position at a predetermined distance away from the second auxiliary line 46 in the direction along the back guide line 44.

The shoulder line 8 intersects the back guide line 44. One end of the shoulder line 8 coincides with the upper end 93 of the back neck 5*b*, while the other end of the shoulder line 8 projects out from the back guide line 44. It is desirable that the length of the portion of the shoulder line 8 projecting out from the back guide line 44 be within the range from 2% or more of the length of the armhole AH to 4% or less of the length of the armhole AH.

A projecting end 95 of the shoulder line 8 is set in this way as a shoulder point SP on the back body 3. The length of the shoulder line 8 (the length from the upper end 93 of the back neck 5*b* to the projecting end 95 of the shoulder line 8) is measured and the shoulder point SP on the sleeve 4 is set on the sleeve head seam line 47 of the sleeve 4 at a position at a distance equal to the length of the shoulder line 8 from a point of intersection 84 of the neck forming portion 83 and the sleeve head seam line 47 of the sleeve 4.

On the front and back bodies 2 and 3, raglan points RP are set as reference points for forming the desired front armhole line 9*a* and back armhole line 9*b*. For example, a raglan point RP on the back body 3 is set as described below. First, as shown in FIG. 12, the distance from a point of intersection 96 of the back guide line 44 and the second auxiliary line 46 to the second sewing reference position 31 is measured.

Next, a length L6 which is ¼ of this length is computed. A position (hereinafter referred to as a "middle point") 97 at a half (middle) of the portion from the point of intersection 96 to the second sewing reference position 31 on the back guide line 44 is then determined. Finally, a point 98 at a distance equal to the length L6 from the middle point toward the back center line 15*b* in the direction orthogonal to the back guide line 44 is determined.

The point 98 is thus determined as a raglan point RP. A raglan point is set in the same way with respect to the first portion to be sewn 6 of the front body 2. The front armhole line 9*a* of the front body 2 and the back armhole line 9*b* of the back body 3 are set as curves such as to extend from the first sewing reference position 21 and the second sewing reference position 31 to the neck via the raglan points RP.

In other respects, the arrangement in the present embodiment is the same as that in the first embodiment. The components common to the first and second embodiments are indicated by the same reference numerals as those in the first embodiment, and the description for them will not be repeated.

In the upper garment 1 according to the present embodiment, the point (the maximum point 87 on the front sleeve attachment line 60*a*) in the front portion to be sewn 54 in the front sleeve portion 51, which point is to be sewn to the first sewing reference position 21 on the first portion to be sewn 6, is projected toward the front body 2 relative to the shoulder point SP on the sleeve 4. Therefore, when the wearer largely moves the arm backward, the portion in the vicinity of the vertex 87 of the front sleeve attachment line 60*a* in the front sleeve portion 51 follows this movement, so that the front body 2 is not easily pulled by the sleeve 4 (front sleeve portion 51). That is, with the above-described arrangement, "ease" for enabling the sleeve 4 to follow the movement of the arm of the wearer is formed around the front portion to be sewn 54 and the back portion to be sewn 55 of the sleeve 4. More specifically, this ease is formed by largely projecting the sleeve attachment lines 60*a* and 60*b* to the body 2 and body 3 sides relative to the sleeve attachment lines (indicated by reference numeral 48) of the conventional raglan-type sleeve, as shown in FIG. 13. That is, in the present embodiment, the area of the sleeve is increased from that of the conventional sleeve by the area of the portion (hatched in FIG. 13) surrounded by the sleeve attachment line 48 of the conventional sleeve and the sleeve attachment lines 60*a* and 60*b* and the sleeve bottom lines 61*a* and 61*b* in the present embodiment. Ease is produced by this portion.

Moreover, even when the wearer largely moves the arm up and down, the portion in the vicinity of the vertex 67 of the front sleeve attachment line 60*a* follows this movement, so that the portion of the front body 2 below the sleeve 4 is not easily pulled.

Also, in the back portion to be sewn 55 in the back sleeve portion 52, the point (the maximum point 89 on the back sleeve attachment line 60*b*) to be sewn to the second sewing reference position 31 on the second portion to be sewn 12 is projected toward the back body 3 relative to the shoulder point SP on the sleeve 4. Therefore, when the wearer largely moves the arm forward by inwardly bending the arm, the portion in the vicinity of the maximum point 89 on the back sleeve attachment line 60*b* in the back sleeve portion 52 follows this movement, so that the back body 3 is not easily pulled by the sleeve 4 (back sleeve portion 52).

Moreover, even when the wearer largely moves the arm up and down, the portion in the vicinity of the vertex 72 of the back sleeve attachment line 60*b* follows this movement, so that the portion of the back body 3 below the sleeve 4 is not easily pulled.

Further, since part of the sleeve 4 is positioned above a line extended from the shoulder line 8 of the body (front body 2, back body 3), the amount of movement of the sleeve 4 when the arm is moved upward is reduced, thereby reducing the pull of the front body 2 from the front sleeve portion 51.

Also, in the front portion to be sewn 54 in the front sleeve portion 51, the point (the maximum point 87 on the front sleeve attachment line 60*a*) to be sewn to the first portion to be sewn 6 is projected toward the front body 2 relative to the base portion 86 in the projecting portion 81 on the front sleeve portion 51 side. Therefore, even when the wearer largely moves the arm backward and when the projecting portion 81 follows this movement, the portion in the vicinity of the maximum point 87 on the front sleeve attachment line 60*a* in the front sleeve portion 51 follows the movement of the projecting portion 81 in the region below the projecting portion 81, so that the front body 2 is not easily pulled by the sleeve 4 (front sleeve portion 51).

In the front portion to be sewn 54 in the front sleeve portion 51, the point (the maximum point 87 on the front sleeve attachment line 60*a*) to be sewn to the first sewing reference position 21 on the first portion to be sewn 6 is projected toward the front body 2 relative to the base portion 86 in the projecting portion 81 on the front sleeve portion 51 side. Therefore, even when the wearer largely moves the arm backward and when the projecting portion 81 follows this movement, the portion in the vicinity of the maximum point 87 on the front sleeve attachment line 60*a* on the front sleeve portion 51 side follows the movement of the projecting portion 81 in the region below the projecting portion 81, so that the front body 2 is not easily pulled by the sleeve 4 (front sleeve portion 51).

Similarly, in the back portion to be sewn 55 in the back sleeve portion 52, the point (the maximum point 89 on the back sleeve attachment line 60*b*) to be sewn to the second sewing reference position 31 on the second portion to be sewn 12 is projected toward the back body 3 relative to the base portion 88 in the projecting portion 81 on the back sleeve portion 52 side. Therefore, even when the wearer largely moves the arm backward and when the projecting portion 81 follows this movement, the portion in the vicinity of the maximum point 89 on the back sleeve attachment line 60*b* on the back sleeve portion 52 side follows the movement of the projecting portion 81 in the region below the projecting portion 81, so that the back body 3 is not easily pulled by the sleeve 4 (front sleeve portion 51).

The present invention is not limited to the above-described embodiments. Various modifications and changes can be made in the embodiments.

For example, the front sleeve attachment line 60*a* and the back sleeve attachment line 60*b* of the second embodiment are not limited to three-order curves. The front sleeve attachment line 60*a* and the back sleeve attachment line 60*b* may be formed of any of other various curves.

With respect to the above-described embodiments, upper garments with half-length sleeves have been described by way of example. However, the present invention is not limit to such upper garments. The present invention can be applied to long sleeve or other various types of upper garments.

The front body, back body and sleeves of the upper garment are formed by cutting cloth on the basis of a predetermined pattern. However, margins to seam, necessary for sewing, are separately formed thereon. With respect to the first sewing reference position, the second sewing reference position, the shoulder points and the raglan points, notches or some other marks may be attached to the corresponding margins to seam for recognition of the positions.

To enable the sleeves of the upper garment to follow the movements of the arms more easily, separate parts such as gussets may be provided in the vicinity of underarm portions, cloth higher in stretchability than that for the bodies may be used only for the sleeves, and working for tucks, pleats or the like may be performed.

As is usual with upper garments for athletic sports in particular, cloth changes are provided for a reason in terms of design, for example, in expressing a lively feeling. Such cloth changes may be provided as desired if the function to follow the movement of the arm is not seriously impaired. Also, the bodies and sleeves may be divided into suitable pieces (may be constituted of a plurality of parts) if the function to follow the movement of the arm is not seriously impaired.

In the upper garment according to the present invention, cloth having high stretchability may be used for close fitting to the body of a wearer. Also, cloth having low or no stretchability or any other cloth may be used as desired provided that a setting is made to enable following the movement of the arm.

INDUSTRIAL APPLICABILITY

The upper garment according to the present invention can be used, for example, in a case where the arm is largely moved forward, backward, up or down as in sports or certain activities.

The invention claimed is:

1. An upper garment having a front body, a back body, sleeves sewn to the bodies and configured to be worn on an upper half of a body of a wearer, the upper garment being characterized in that each sleeve has a front sleeve portion and a back sleeve portion and is formed into a tubular shape by sewing the front sleeve portion and the back sleeve portion to each other;

the front sleeve portion has a front portion to be sewn, which is sewn to the front body, a front sleeve attachment line having a curved shape that is sewn, as an edge of the front portion to be sewn, to the front body, and a front sleeve bottom line representing a first end portion to be sewn, which is sewn to the back sleeve portion to form the sleeve portions into the tubular shape;

the back sleeve portion has a back portion to be sewn, which is sewn to the back body, a back sleeve attachment line having a curved shape that is sewn, as an edge of the back portion to be sewn, to the back body, and a back sleeve bottom line representing a second end portion to be sewn, which is sewn to the front sleeve portion to form the sleeve portions into the tubular shape;

a boundary portion between the front portion to be sewn and the back portion to be sewn forms a shoulder point configured to correspond to an outer end of a shoulder of the wearer when the front portion to be sewn is sewn to the front body, and when the back portion to be sewn is sewn to the back body;

the front body has a first portion to be sewn, to which the front portion to be sewn of the sleeve is sewn, and on which a first sewing reference position serving as a reference when the front portion to be sewn of the sleeve is sewn is set, the first sewing reference position being positioned nearest to a center of the front body in a widthwise direction in the first portion to be sewn;

the back body has a second portion to be sewn, to which the back portion to be sewn of the sleeve is sewn, and on which a second sewing reference position serving as a reference when the back portion to be sewn of the sleeve is sewn is set, the second sewing reference position being positioned nearest to a center of the back body in a widthwise direction in the second portion to be sewn;

a portion to be sewn to the first sewing reference position on the front body in the front portion to be sewn in the front sleeve portion of the front sleeve attachment line projects toward the front body relative to the shoulder point, and projects toward the front body relative to a boundary point between the front sleeve attachment line and the front sleeve bottom line, the boundary point between the front sleeve attachment line and the front sleeve bottom line being a corner of the front sleeve attachment line and the front sleeve bottom line, the corner of the front sleeve attachment line and the front sleeve bottom line being an intersection of the front sleeve attachment line and the front sleeve bottom line; and a portion to be sewn to the second sewing reference position on the back body in the back portion to be sewn in the back sleeve portion of the back sleeve attachment line projects toward the back body relative to the shoulder point, and projects toward the back body relative to a boundary point between the back sleeve attachment line and the back sleeve bottom line, the boundary point between the back sleeve attachment line and the back sleeve bottom line being a corner of the back sleeve attachment line and the back sleeve bottom line, the corner of the back sleeve attachment line and the back sleeve bottom line being an intersection of the back sleeve attachment line and the back sleeve bottom line, so that the shoulder point on the sleeve is positioned between the portion in the front portion to be sewn in the front sleeve portion, which portion is sewn to the first sewing reference position on the front body, and the portion in the back portion to be sewn in the back sleeve portion, which portion is sewn to the second sewing reference position on the back body, and so that the shoulder point on the sleeve is positioned at a bottom most portion in a concave portion formed by the front sleeve attachment line and the back sleeve attachment line, while part of a sleeve mouth of each of the sleeves is positioned above a line extended linearly from a shoulder line toward the sleeve that is continuous with the shoulder line, when the sleeve is sewn to the front body and to the back body, wherein the shoulder line is an upper end edge of a corresponding shoulder portion of the upper garment and passes through the shoulder point; and wherein a sleeve width line connecting the boundary point between the front sleeve attachment line and the front sleeve bottom line and the boundary point between the back sleeve attachment line and the back sleeve bottom line and extending along the widthwise direction is drawn, and wherein a length of a line drawn from the shoulder point so as to be perpendicular to the sleeve width line is A; a length of a line drawn from the portion sewn to the first sewing reference position on the front body in the front portion to be sewn in the front sleeve portion so as to be perpendicular to the sleeve width line is B; and a length of a line drawn from the portion sewn to the second sewing reference position on the back body in the back portion to be sewn in the back sleeve portion so as to be perpendicular to the sleeve width line is C, a relationship of $A<B$ and a relationship of $A<C$ are established.

2. An upper garment having a front body, a back body, sleeves sewn to the bodies and configured to be worn on an upper half of a body of a wearer, the upper garment being characterized in that each sleeve has a front sleeve portion and a back sleeve portion and is formed into a tubular shape by sewing the front sleeve portion and the back sleeve portion to each other;

the front sleeve portion has a front portion to be sewn, which is sewn to the front body, a front sleeve attachment line having a curved shape that is sewn, as an edge of the front portion to be sewn, to the front body, and a front sleeve bottom line representing a first end portion to be sewn, which is sewn to the back sleeve portion to form the sleeve portions into the tubular shape;

the back sleeve portion has a back portion to be sewn, which is sewn to the back body, a back sleeve attachment line having a curved shape that is sewn, as an edge of the back portion, to be sewn to the back body, and a back sleeve bottom line representing a second end portion to be sewn, which is sewn to the front sleeve portion to form the sleeve portions into the tubular shape;

a boundary portion between the front portion to be sewn and the back portion to be sewn forms a shoulder point configured to correspond to an outer end of a shoulder of the wearer when the front portion to be sewn is sewn to the front body, and when the back portion to be sewn is sewn to the back body;

the front body has a first portion to be sewn, to which the front portion to be sewn of the sleeve is sewn, and on which a first sewing reference position serving as a reference when the front portion to be sewn of the sleeve is sewn is set, the first sewing reference position being positioned nearest to a center of the front body in a widthwise direction in the first portion to be sewn;

the back body has a second portion to be sewn, to which the back portion to be sewn of the sleeve is sewn, and on which a second sewing reference position serving as a reference when the back portion to be sewn of the sleeve is sewn is set, the second sewing reference position being positioned nearest to a center of the back body in a widthwise direction in the second portion to be sewn;

a portion to be sewn to the first sewing reference position on the front body in the front portion to be sewn in the front sleeve portion projects toward the front body relative to the shoulder point, and projects toward the front body relative to a boundary point between the front sleeve attachment line and the front sleeve bottom line, the boundary point between the front sleeve attachment line and the front sleeve bottom line being a corner of the front sleeve attachment line and the front sleeve bottom line, the corner of the front sleeve attachment line and the front sleeve bottom line being an intersection of the front sleeve attachment line and the front sleeve bottom line; and a portion to be sewn to the second sewing reference position on the back body in the back portion to be sewn in the back sleeve portion projects toward the back body relative to the shoulder point, and projects toward the back body relative to a boundary point between the back sleeve attachment line and the back sleeve bottom line, the boundary point between the back sleeve attachment line and the back sleeve bottom line being a corner of the back sleeve attachment line and the back sleeve bottom line, the corner of the back sleeve attachment line and the back sleeve bottom line being an intersection of the back sleeve attachment line and the back sleeve bottom line, so that the shoulder point on the sleeve is positioned at a center of the sleeve in the widthwise direction and at a bottom most portion in a concave portion formed by the front sleeve attachment line and the back sleeve attachment line, while part of a sleeve mouth of each of the sleeves is positioned above a line extended linearly from a shoulder line toward the sleeve that is continuous with the shoulder line, when the sleeve is sewn to the front body and to the back body, wherein the shoulder line is an upper end edge of a corresponding shoulder portion of the upper garment and passes through the shoulder point; and wherein a sleeve width line connecting the boundary point between the front sleeve attachment line and the front sleeve bottom line and the boundary point between the back sleeve attachment line and the back sleeve bottom line and extending along the widthwise direction is drawn, and wherein a length of a line drawn from the shoulder point so as to be perpendicular to the sleeve width line is A; a length of a line drawn from the portion sewn to the first sewing reference position on the front body in the front portion to be sewn in the front sleeve portion so as to be perpendicular to the sleeve width line is B; and a length of a line drawn from the portion sewn to the second sewing reference position on the back body in the back portion to be sewn in the back sleeve portion so as to be perpendicular to the sleeve width line is C, a relationship of $A<B$ and a relationship of $A<C$ are established.

3. The upper garment according to claim 1 or 2, wherein the first sewing reference position is configured to be set in correspondence with a crest of a greater tubercle of the wearer.

4. The upper garment according to claim 1 or 2, wherein the second sewing reference position is configured to be set in correspondence with an infraglenoid tubercle of the wearer.

* * * * *